US010807401B2

(12) United States Patent
Shirakawa et al.

(10) Patent No.: US 10,807,401 B2
(45) Date of Patent: Oct. 20, 2020

(54) CYLINDRICAL PRINTING PLATE, CYLINDRICAL PRINTING PLATE PRECURSOR, METHOD FOR MANUFACTURING CYLINDRICAL PRINTING PLATE PRECURSOR, AND METHOD FOR MANUFACTURING CYLINDRICAL PRINTING PLATE

(71) Applicant: FUJIFILM Corporation, Tokyo (JP)

(72) Inventors: Masato Shirakawa, Haibara-gun (JP); Yusuke Namba, Haibara-gun (JP)

(73) Assignee: FUJIFILM Corporation, Minato-Ku, Tokyo (JP)

( * ) Notice: Subject to any disclaimer, the term of this patent is extended or adjusted under 35 U.S.C. 154(b) by 272 days.

(21) Appl. No.: 16/045,892

(22) Filed: Jul. 26, 2018

(65) Prior Publication Data

US 2018/0339536 A1 Nov. 29, 2018

Related U.S. Application Data

(63) Continuation of application No. PCT/JP2017/002523, filed on Jan. 25, 2017.

(30) Foreign Application Priority Data

Feb. 2, 2016 (JP) ..... 2016-017784

(51) Int. Cl.
*B41N 1/22* (2006.01)
*B41C 1/18* (2006.01)
(Continued)

(52) U.S. Cl.
CPC ..... *B41N 1/22* (2013.01); *B41C 1/025* (2013.01); *B41C 1/05* (2013.01); *B41C 1/18* (2013.01); *B41N 1/12* (2013.01)

(58) Field of Classification Search
None
See application file for complete search history.

(56) References Cited

U.S. PATENT DOCUMENTS 3,085,507 A 4/1963 Kunetka
7,841,277 B1 11/2010 Van Denend
(Continued)

FOREIGN PATENT DOCUMENTS

JP 38-3002 Y1 2/1963
JP 2003-25749 A 1/2003
(Continued)

OTHER PUBLICATIONS

Communication dated Feb. 12, 2019 from the European Patent Office in application No. 17747277.6.
(Continued)

*Primary Examiner* — Joshua D Zimmerman
(74) *Attorney, Agent, or Firm* — Sughrue Mion, PLLC

(57) ABSTRACT

Provided is to provide a cylindrical printing plate with which printing of excellent solid density and high halftone dot quality is made possible, and further print medium followability and printing durability are excellent, a cylindrical printing plate precursor, a method for manufacturing a cylindrical printing plate precursor, and a method for manufacturing a cylindrical printing plate. A cylindrical printing plate includes a relief layer having a first hard layer, a soft layer, and a second hard layer in this order from a printing surface side, in which a hardness K1 of the first hard layer is 10 MPa or more and less than 20 MPa, a ratio K1/K2 of the hardness K1 of the first hard layer with respect to a hardness K2 of the soft layer is 2.7 or more, a ratio K3/K2 of a hardness K3 of the second hard layer with respect to the hardness K2 of the soft layer is 1.2 or more, a thickness of the first hard layer is 0.05 mm or more and 0.3 mm or less,
(Continued)

and a thickness of the soft layer is 0.3 mm or more and 2.0 mm or less.

14 Claims, 3 Drawing Sheets

(51) Int. Cl.

| | |
|---|---|
| ***B41N 1/12*** | (2006.01) |
| ***B41C 1/05*** | (2006.01) |
| ***B41C 1/02*** | (2006.01) |

(56) References Cited

U.S. PATENT DOCUMENTS

| | | | |
|---|---|---|---|
| 2003/0217661 | A1 | 11/2003 | Schnieders |
| 2006/0230964 | A1 | 10/2006 | Watanabe et al. |
| 2009/0081414 | A1 | 3/2009 | Sugasaki |
| 2009/0126588 | A1 | 5/2009 | Watanabe et al. |
| 2012/0082836 | A1 | 4/2012 | Sugasaki |
| 2013/0000503 | A1 | 1/2013 | Amiel-Levy et al. |

FOREIGN PATENT DOCUMENTS

| | | | |
|---|---|---|---|
| JP | 2004-255812 | A | 9/2004 |
| JP | 2006-2061 | A | 1/2006 |
| JP | 2009-78467 | A | 4/2009 |
| WO | 99/36270 | A1 | 7/1999 |
| WO | 2005/005147 | A1 | 1/2005 |

OTHER PUBLICATIONS

Written Opinion dated Apr. 18, 2017 in counterpart international application No. PCT/JP2017/002523.

International Preliminary Report on Patentability dated Aug. 7, 2018 in counterpart international application No. PCT/JP2017/002523.

International Search Report dated Apr. 18, 2017 in counterpart international application No. PCT/JP2017/002523.

CYLINDRICAL PRINTING PLATE, CYLINDRICAL PRINTING PLATE PRECURSOR, METHOD FOR MANUFACTURING CYLINDRICAL PRINTING PLATE PRECURSOR, AND METHOD FOR MANUFACTURING CYLINDRICAL PRINTING PLATE

CROSS-REFERENCE TO RELATED APPLICATIONS

This application is a Continuation of PCT International Application No. PCT/JP2017/002523 filed on Jan. 25, 2017, which claims priority under 35 U.S.C. § 119(a) to Japanese Patent Application No. 2016-017784 filed on Feb. 2, 2016. The above application is hereby expressly incorporated by reference, in its entirety, into the present application.

BACKGROUND OF THE INVENTION

1. Field of the Invention

The present invention relates to a cylindrical printing plate, a cylindrical printing plate precursor, a method for manufacturing a cylindrical printing plate precursor, and a method for manufacturing a cylindrical printing plate.

2. Description of the Related Art

In the flexographic printing and letterpress printing field, a letterpress printing plate on which a relief is formed imagewise has been used. As a plating making method for the printing plate used herein, for example, a method in which a printing plate precursor having a relief forming layer formed of a photosensitive composition on a support is exposed to ultraviolet light through an original image film, an image area is selectively cured, and an uncured area is removed with a developer, and a method in which using a relief printing plate precursor on which a laser sensitive mask layer element that is capable of forming an image mask is provided on a relief forming layer, a mask layer is removed by laser irradiation (image mask formation) based on image data, and then the printing plate precursor is exposed to ultraviolet light through the image mask to develop an uncured area (LAM method) have been proposed. Further, in recent years, as a plating making method which does not require a developing step, a plate making method using a printing plate precursor having a layer on which a relief can be formed by direct image drawing with laser, so-called "direct engraving CTP method (DLE method)" has been proposed (for example, JP2006-2061A and JP2009-78467A).

On the other hand, as an embodiment of the printing plate, a sheet-like printing plate has been provided to cope with a method in which a printing plate is directly attached to a plate cylinder of a printing machine or a printing plate is attached to a cylinder that can be mounted on a plate cylinder and the whole cylinder is inserted into a plate cylinder. However, in recent years, a seamless cylindrical printing plate has been provided from the viewpoint of print quality deterioration caused by seams formed by attachment of a sheet-like printing plate and suitability for printing of an endless image. These printing plates can be obtained by manufacturing a cylindrical printing plate precursor in which a resin layer on which a relief can be formed is applied onto a cylindrical support that can be mounted on a plate cylinder and then forming a relief imagewise.

In a cylindrical printing plate formed from such a seamless cylindrical printing plate precursor, it is found that since the film thickness of the relief forming layer of the sheet-like printing plate is thick and pressure is not sufficiently applied to an image area, the density of a solid image area (hereinafter, referred to as "solid density") is deteriorated compared to the sheet-like printing plate. On the other hand, in a case where pressure is applied to the image area by increasing the pressing amount at the time of printing to improve the solid density, halftone dots are largely deformed, the reproduction density of the minimum dot is increased, and thus there is a problem of deterioration in halftone dot quality. Accordingly, there is an essential problem that the print quality of the cylindrical printing plate is deteriorated compared to a sheet-like printing plate. Therefore, JP2003-25749A discloses that a balance between a solid pattern and a halftone dot pattern is improved by laminating at least a core sleeve layer, a cushion layer, a rigid layer, and a seamless print relief layer.

In addition, JP2004-255812A discloses that a modified layer is formed on a surface of a printing plate so as to improve the ink wettability of the surface of the printing plate.

However, since a sufficient pressure is not applied to a solid image area at the time of printing, a satisfactory solid density cannot be obtained, and in a case where printing is performed on a print medium having roughness, the followability of the plate (print medium followability) which follows the roughness on the print medium is not sufficient. Therefore, it is not able to solve the problem that blur occurs in a printed material.

SUMMARY OF THE INVENTION

An object of the present invention is to provide a cylindrical printing plate with which printing of excellent solid density and high halftone dot quality is made possible, and further print medium followability and printing durability are excellent, a cylindrical printing plate precursor, a method for manufacturing a cylindrical printing plate precursor, and a method for manufacturing a cylindrical printing plate.

As a result of conducting intensive investigations to achieve the above object, the present inventors have found that by adopting a configuration in which a relief layer having a first hard layer, a soft layer, and a second hard layer in this order from a printing surface side is provided, a hardness K1 of the first hard layer is 10 MPa or more and less than 20 MPa, a ratio K1/K2 between the hardness K1 of the first hard layer and a hardness K2 of the soft layer is 2.7 or more, a ratio K3/K2 between a hardness K3 of the second hard layer and the hardness K2 of the soft layer is 1.2 or more, a thickness of the first hard layer is 0.05 mm or more and 0.3 mm or less, and a thickness of the soft layer is 0.3 mm or more and 2.0 mm or less, printing of excellent solid density and high halftone dot quality is made possible, and further print medium followability and printing durability are excellent, and thus have completed the present invention.

That is, the present invention provides a cylindrical printing plate having the following configurations, a cylindrical printing plate precursor, a method for manufacturing a cylindrical printing plate precursor, and a method for manufacturing a cylindrical printing plate.

(1) A cylindrical printing plate comprising:

a relief layer having a first hard layer, a soft layer, and a second hard layer in this order from a printing surface side, in which a hardness K1 of the first hard layer is 10 MPa or more and less than 20 MPa, a ratio K1/K2 of the hardness K1 of the first hard layer with respect to a hardness K2 of the soft layer is 2.7 or more, a ratio K3/K2 of a hardness K3 of the second hard layer with respect to the hardness K2 of the soft layer is 1.2 or more, a thickness of the first hard layer is 0.05 mm or more and 0.3 mm or less, and a thickness of the soft layer is 0.3 mm or more and 2.0 mm or less.

(2) The cylindrical printing plate according to (1), in which the hardness K2 of the soft layer is less than 5 MPa.

(3) The cylindrical printing plate according to (1) or (2), in which the hardness K3 of the second hard layer is 5 MPa or more and less than 10 MPa.

(4) The cylindrical printing plate according to any one of (1) to (3), in which a thickness of the second hard layer is 2.0 mm or more.

(5) The cylindrical printing plate according to any one of (1) to (4), in which the first hard layer contains a crystalline polymer.

(6) The cylindrical printing plate according to any one of (1) to (5), in which the crystalline polymer is at least one selected from a polybutadiene-based thermoplastic elastomer and a polyolefin-based thermoplastic elastomer.

(7) A cylindrical printing plate precursor comprising:

a relief forming layer having a first hard layer, a soft layer, and a second hard layer in this order from a printing surface side, in which a hardness K1 of the first hard layer is 10 MPa or more and less than 20 MPa, a ratio K1/K2 of the hardness K1 of the first hard layer with respect to a hardness K2 of the soft layer is 2.7 or more, a ratio K3/K2 of a hardness K3 of the second hard layer with respect to the hardness K2 of the soft layer is 1.2 or more, a thickness of the first hard layer is 0.05 mm or more and 0.3 mm or less, and a thickness of the soft layer is 0.3 mm or more and 2.0 mm or less.

(8) The cylindrical printing plate precursor according to (7), in which the hardness K2 of the soft layer is less than 5 MPa.

(9) The cylindrical printing plate precursor according to (7) or (8), in which the hardness K3 of the second hard layer is 5 MPa or more and less than 10 MPa.

(10) The cylindrical printing plate precursor according to any one of (7) to (9), in which a thickness of the second hard layer is 2.0 mm or more.

(11) The cylindrical printing plate precursor according to any one of (7) to (10), in which the first hard layer contains a crystalline polymer.

(12) The cylindrical printing plate precursor according to (11), in which the crystalline polymer is at least one selected from a polybutadiene-based thermoplastic elastomer and a polyolefin-based thermoplastic elastomer.

(13) A method for manufacturing a cylindrical printing plate precursor comprising:

an uncured layer forming step of forming, on a peripheral surface of a cylindrical support, an uncured relief forming layer having a first uncured layer which becomes a first hard layer, a second uncured layer which becomes a soft layer, and a third uncured layer which becomes a second hard layer in this order from the cylindrical support; and a curing step of curing the formed first uncured layer, second uncured layer, and third uncured layer to form a relief forming layer having the first hard layer, the soft layer, and the second hard layer, in which a hardness K1 of the first hard layer after curing is 10 MPa or more and less than 20 MPa, a ratio K1/K2 of the hardness K1 of the first hard layer with respect to a hardness K2 of the soft layer after curing is 2.7 or more, a ratio K3/K2 of a hardness K3 of the second hard layer with respect to the hardness K2 of the soft layer after curing is 1.2 or more, a thickness of the first hard layer after curing is 0.05 mm or more and 0.3 mm or less, and a thickness of the soft layer after curing is 0.3 mm or more and 2.0 mm or less.

(14) A method of manufacturing a cylindrical printing plate comprising:

an engraving step of performing laser engraving on the relief forming layer of the cylindrical printing plate precursor manufactured by the method of manufacturing a cylindrical printing plate precursor according to (13) to form a relief layer.

According to the present invention, it is possible to provide a cylindrical printing plate with which printing of excellent solid density and high halftone dot quality is made possible, and further print medium followability and printing durability are excellent, a cylindrical printing plate precursor, a method for manufacturing a cylindrical printing plate precursor, and a method for manufacturing a cylindrical printing plate.

DESCRIPTION OF THE PREFERRED EMBODIMENTS

Hereinafter, a cylindrical printing plate, a cylindrical printing plate precursor, a method for manufacturing a cylindrical printing plate precursor, and a method for manufacturing a cylindrical printing plate of the present invention will be described in detail based on preferred embodiments shown in the accompanying drawings.

In the following description, there are cases in which configurational requirements will be described based on typical embodiments of the present invention, but the present invention is not limited to these embodiments.

[Cylindrical Printing Plate and Cylindrical Printing Plate Precursor]

A cylindrical printing plate according to the present invention includes a relief layer having a first hard layer, a soft layer, and a second hard layer in this order from a printing surface side, in which a hardness K1 of the first hard layer is 10 MPa or more and less than 20 MPa, a ratio K1/K2 of the hardness K1 of the first hard layer with respect to a hardness K2 of the soft layer is 2.7 or more, a ratio K3/K2 of a hardness K3 of the second hard layer with respect to the hardness K2 of the soft layer is 1.2 or more, a thickness of the first hard layer is 0.05 mm or more and 0.3 mm or less, and a thickness of the soft layer is 0.3 mm or more and 2.0 mm or less.

In addition, a cylindrical printing plate precursor according to the present invention includes a relief forming layer having a first hard layer, a soft layer, and a second hard layer in this order from a printing surface side, in which a hardness K1 of the first hard layer is 10 MPa or more and less than 20 MPa, a ratio K1/K2 of the hardness K1 of the first hard layer with respect to a hardness K2 of the soft layer is 2.7 or more, a ratio K3/K2 of a hardness K3 of the second hard layer with respect to the hardness K2 of the soft layer is 1.2 or more, a thickness of the first hard layer is 0.05 mm or more and 0.3 mm or less, and a thickness of the soft layer is 0.3 mm or more and 2.0 mm or less.

Hereinafter, the configurations of the cylindrical printing plate and the cylindrical printing plate precursor according to the present invention will be described in detail based on the accompanying drawings.

In the present invention, the term "relief forming layer" refers to a layer on which a relief can be formed by laser engraving, and the layer after the relief is formed is referred to as a "relief layer". That is, the cylindrical printing plate precursor and the cylindrical printing plate according to the present invention each have a relief forming layer on which a relief can be formed by laser engraving or the like and basically have the same configuration only except that the relief layer is provided after the relief is formed.

Figure 1:
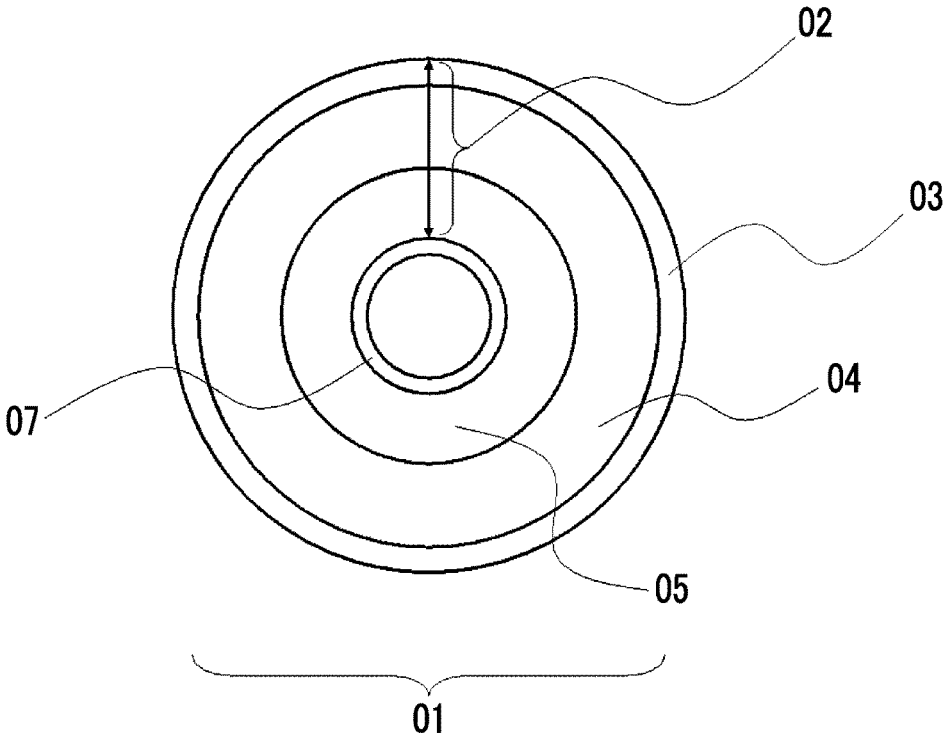
FIG. 1 is a cross-sectional view of a cylindrical printing plate precursor.
Figure 2:
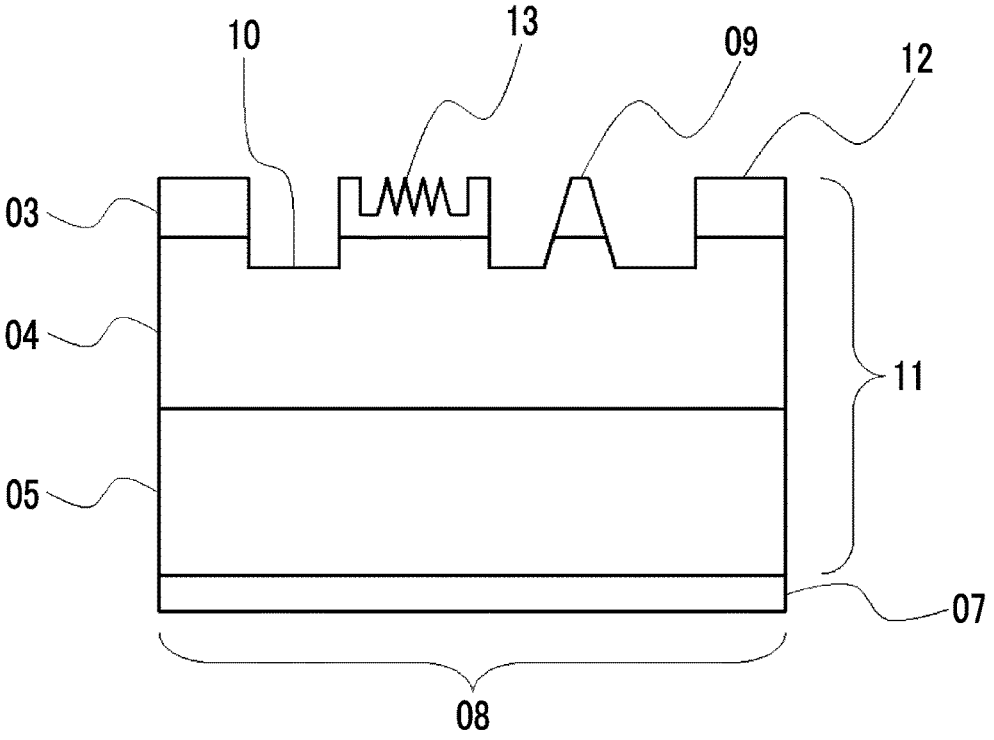
FIG. 2 is a cross-sectional view of a relief layer of a cylindrical printing plate.

FIG. 1 is a cross-sectional view schematically showing an example of the cylindrical printing plate precursor according to the present invention, and FIG. 2 is a schematic cross-sectional view of a part of the cylindrical printing plate according to the present invention in an enlarged manner. FIG. 2 is a partial cross-sectional view of the cylindrical printing plate produced by forming a relief on the relief forming layer of the cylindrical printing plate precursor shown in FIG. 1 in an enlarged manner.

As shown in FIG. 1, a cylindrical printing plate precursor 01 which is an example of the cylindrical printing plate precursor according to the present invention has a cylindrical support 07 and a relief forming layer 02 which is arranged on the peripheral surface of the cylindrical support 07. The relief forming layer 02 has a configuration in which a second hard layer 05, a soft layer 04, and a first hard layer 03 are laminated in this order from the cylindrical support 07 side. That is, the first hard layer 03 side becomes a surface side (printing surface side).

As shown in FIG. 2, a cylindrical printing plate 08 which is an example of the cylindrical printing plate according to the present invention has a cylindrical support 07, and a relief layer 11 which is arranged on the peripheral surface of the cylindrical support 07. The relief layer 11 has a configuration in which a second hard layer 05, a soft layer 04, and a first hard layer 03 are laminated in this order from the cylindrical support 07 side. Engraving is performed on the relief layer 11 from the surface of the first hard layer 03 side and thus an image area 09 and a non-image area 10 are formed. That is, the surface of the first hard layer 03 side becomes a printing surface.

The image area 09 is a region where an ink is applied at the time of printing and the ink is transferred to an object to be printed, that is, an image is formed at the time of printing. In addition, the non-image area 10 is a region where an ink is not applied at the time of printing, that is, an image is not formed.

In addition, the image area 09 includes a solid image area 12 in which printing is performed so as to fill the image area by transferring an ink to the entire surface and/or a halftone dot portion 13 which is formed by a large number of convex halftone dots and in which the gradation of an image printed on an object to be printed is expressed by changing the size or density of the halftone dot.

The halftone dots constituting the halftone dot portion 13 are typically formed with a predetermined number of screen lines, for example, about 100 to 300 lpi (line per inch).

Herein, in the present invention, as shown in FIG. 1, the relief forming layer is configured such that the first hard layer, the soft layer, and the second hard layer are laminated in this order from the printing surface of the cylindrical printing plate precursor. In the same manner, as shown in FIG. 2, the relief layer is configured such that the first hard layer, the soft layer, and the second hard layer are laminated in this order from the printing surface of the cylindrical printing plate.

Further, in the present invention, the hardness K1 of the first hard layer is 10 MPa or more and less than 20 MPa, a ratio K1/K2 of the hardness K1 of the first hard layer with respect to the hardness K2 of the soft layer is 2.7 or more, and a ratio K3/K2 of the hardness K3 of the second hard layer with respect to the hardness K2 of the soft layer is 1.2 or more.

Further, in the present invention, the thickness of the first hard layer is 0.05 mm or more and 0.3 mm or less and the thickness of the soft layer is 0.3 mm or more and 2.0 mm or less.

As described above, in the cylindrical printing plate of the related art, in order to improve a balance of print quality between a solid pattern and a halftone dot pattern, it is considered that by arranging the rigid layer between the print relief layer and the cushion layer, the stress of compression that the convex relief receives at the time of printing is dispersed to the cushion layer.

However, in a case where the stress of compression that the convex relief receives at the time of printing is dispersed to the cushion layer, it is found that a sufficient pressure is not applied to the solid image area at the time of printing and a high density cannot be obtained.

In contrast, in the cylindrical printing plate and the cylindrical printing plate precursor of the present invention, the relief layer and the relief forming layer each have the first hard layer, the soft layer, and the second hard layer in this order, and the hardness and thickness of the first hard layer, the ratios between the hardness of the soft layer and the hardness of the first hard layer and the second hard layer, and the thickness of the soft layer are set to be in predetermined ranges.

By using the first hard layer having a predetermined hardness or more as the outermost surface of the relief layer (relief forming layer) and setting the hardness K1 and thickness of the first hard layer within the above ranges, a high pressure can be applied to the solid image area and thus a high solid density can be obtained. In addition, deformation in the halftone dot portion can be suppressed and in the above hardness range, high halftone dot quality (the highlight density can be suppressed) can be obtained without impairing printing durability. In addition, by using the soft layer, which is softer than the first hard layer, as an underlayer of the first hard layer, and the second hard layer, which is harder than the soft layer, as an underlayer of the soft layer, and setting the ratios of the hardness K2 of the soft layer with respect to the hardness of the first hard layer and the second hard layer and the thickness of the soft layer within the above ranges, high followability of the cylindrical printing plate with respect to a print medium can be obtained.

Herein, from the viewpoint of obtaining a high solid density and a high halftone dot quality, and obtaining printing durability and the like, the hardness K1 of the first hard layer is preferably 12 MPa or more and less than 18 MPa and more preferably 14 MPa or more and less than 16 MPa.

The hardness K2 of the soft layer is preferably less than 5 MPa and more preferably 3 MPa or less. By setting the hardness K2 of the soft layer within the above range, the followability of the cylindrical printing plate with respect to a print medium can be improved.

The hardness K3 of the second hard layer is preferably 5 MPa or more and less than 10 MPa or less and more preferably 6 MPa or more and 8 MPa or less. In a case where the hardness K3 of the second hard layer is smaller than the hardness within the above range, the pressure to be applied to the solid image area is decreased and the solid density is decreased. In a case where the hardness of the second hard layer is larger than the hardness within the above range, deformation in the soft layer is suppressed and the followability of the cylindrical printing plate with respect to a print medium is impaired.

Figure 3:
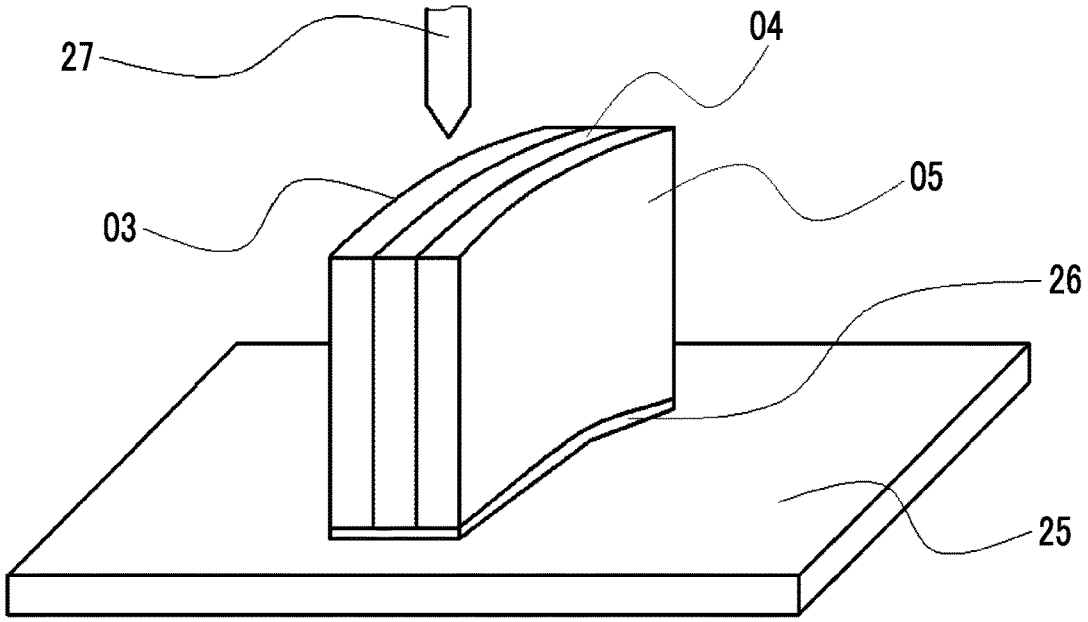
FIG. 3 is a schematic perspective view for illustrating a method for measuring the hardness of each layer of the cylindrical printing plate.

The hardness of each layer can be measured with FischerScope HM2000Xyp (manufactured by Fischer Instruments K.K.) as shown in FIG. 3.

The relief layer 11 of the produced cylindrical printing plate is cut out in a size of about 3 cm square and is fixed onto a slide glass 25 with an adhesive 26 such that the cross section of the relief layer 11 faces upwardly. Regarding the first hard layer 03, the soft layer 04, and the second hard layer 05, the Martens hardness in a case where a measurement detector 27 is pressed from upper portions of the respective layers and the layers are pressed by 10 μm is used as the hardness of each layer.

In addition, the thickness of the first hard layer is 0.05 mm or more and 0.3 mm or less and preferably 0.1 mm or more and 0.15 mm or less. In a case where the thickness of the first hard layer is thinner than the thickness within the above range, the effect of suppressing deformation of the halftone dot portion is not sufficient and there is a concern that the halftone dot quality may be impaired. In addition, in a case where the thickness of the first hard layer is thicker than the thickness within the above range, there is a concern that followability to a print medium may be impaired.

The thickness of the soft layer is 0.3 mm or more and 2.0 mm or less and preferably 1.0 mm or more and 0.15 mm or less. In a case where the thickness of the soft layer is thinner than the thickness within the above range, there is a concern that followability to a print medium may be impaired. In a case where the thickness of the soft layer is thicker than the thickness within the above range, the pressure to be applied to the solid image area is decreased and thus there is a concern that the solid density may be decreased.

In addition, the thickness of the second hard layer is preferably 2.0 mm or more. In a case where the thickness of the second hard layer is thinner than the thickness within the above range, the pressure applied to the solid image area is decreased and thus there is a concern that the solid density may be decreased.

The thickness of each layer can be measured by photographing the cross section thereof with a digital microscope KH-7700 (manufactured by Hirox Co., Ltd.).

In addition, from the viewpoint of ease of formation of the relief layer and hardness thereof, it is preferable that the first hard layer contains a crystalline polymer. As the crystalline polymer, a polymer selected from a polybutadiene-based thermoplastic elastomer and a polyolefin-based thermoplastic elastomer is more preferable. Specific materials will be described later.

In addition, the cylindrical printing plate and the cylindrical printing plate precursor may have a cushion layer, a rigid layer, or the like on a lower side of the relief layer or the relief forming layer (the surface opposite to a surface to be engraved). In other words, the relief layer (relief forming layer) may have one or more layers on a lower side of the second hard layer.

In the example shown in FIGS. 1 and 2, the first hard layer, the soft layer, and the second hard layer are respectively constituted of one layer. However, there is no limitation thereto. At least one of the first hard layer, the soft layer, or the second hard layer may be constituted of two or more layers (hereinafter, also referred to as "unit layers"). In a case where any of the first hard layer, the soft layer, and the second hard layer is formed of two or more unit layers, the hardness of the unit layers constituting the corresponding layer is respectively measured and a weighted average of the hardness based on the thickness of each unit layer is used as the hardness of the corresponding layer. In addition, the total thickness of the unit layers constituting the corresponding layer is used as the thickness of the corresponding layer.

The cylindrical support is a member which cylindrically supports the relief layer (relief forming layer) and is provided to attach the cylindrical printing plate to a printing apparatus.

The used material and structure of the cylindrical support are not particularly limited as long as the cylindrical support can support the relief layer (relief forming layer) and can be attached to a printing apparatus. The shape of the cylindrical support may be a hollow cylindrical shape or a columnar shape as long as the support can cylindrically support the relief layer (relief forming layer). As the cylindrical support, hollow cylindrical supports such as cylinders formed of a metal, rubber, or plastic and sleeves formed of a metal, plstic, or fiber reinforced plastic may be used and from the viewpoint of weight and handleability, a hollow cylindrical support is preferable.

In addition, a cylinder of a printing apparatus may be used as the cylindrical support and a sleeve mounted to a cylinder of a printing apparatus may be used as the cylindrical support.

As the material for constituting the metal cylinder or a metal sleeve, materials such as aluminum, nickel, iron, and alloys thereof may be used.

Examples of the material for constituting the plastic cylinder or the plastic sleeve include materials such polyester, polyimide, polyamide, polyphenylene ether, polyphenylene thioether, polysulfone, and an epoxy resin.

Examples of the fiber material for constituting the fiber reinforced plastic sleeve include materials such as a polyester fiber, a polyimide fiber, a polyamide fiber, a polyurethane fiber, a cellulose fiber, a glass fiber, a metal fiber, a ceramic fiber, and a carbon fiber.

Examples of the material for constituting the rubber cylinder include ethylene-propylene-diene (EPDM) rubber, fluorine rubber, silicone rubber, styrene-butadiene (SB) rubber, and urethane rubber.

The diameter of the cylindrical support may be appropriately set according to the thickness of the relief layer (relief forming layer), the specification of the printing apparatus, or the like.

In a case where the cylindrical support is a hollow cylindrical support (sleeve), the thickness of the hollow cylindrical support is preferably 0.2 mm or more and 2 mm or less, more preferably 0.3 mm or more and 1.5 mm or less, and even more preferably 0.4 mm or more and 1 mm or less. As long as the thickness of the hollow cylindrical support is within the above range, mounting thereof on a cylinder of a printing apparatus is easy and sufficient mechanical strength can be maintained without bending or cracking.

[Method for Manufacturing Cylindrical Printing Plate Precursor]

Next, a method for manufacturing a cylindrical printing plate precursor according to the present invention will be described. In addition, the method for manufacturing a printing plate precursor is not limited to this embodiment.

The method for manufacturing a cylindrical printing plate precursor of the present invention includes an uncured layer forming step of forming, on a peripheral surface of a cylindrical support, an uncured relief forming layer having a first uncured layer which becomes a first hard layer, a second uncured layer which becomes a soft layer, and a third uncured layer which becomes a second hard layer in this order from a side of the cylindrical support; and a curing step of curing the formed first uncured layer, second uncured layer, and third uncured layer to form a relief forming layer having the first hard layer, the soft layer, and the second hard layer, in which a hardness K1 of the first hard layer after curing the resin sheet is 10 MPa or more and less than 20 MPa, a ratio K1/K2 of the hardness K1 of the first hard layer with respect to a hardness K2 of the soft layer is 2.7 or more, a ratio K3/K2 of a hardness K3 of the second hard layer with respect to the hardness K2 of the soft layer is 1.2 or more, a thickness of the first hard layer is 0.05 mm or more and 0.3 mm or less, and a thickness of the soft layer is 0.3 mm or more and 2.0 mm or less.

Next, each step will be described in detail.

[Uncured Layer Forming Step]

The uncured layer forming step is a step of forming, an uncured relief forming layer having a first uncured layer which becomes a first hard layer, a second uncured layer which becomes a soft layer, and a third uncured layer which becomes a second hard layer on a peripheral surface of a cylindrical support.

The uncured relief forming layer is formed by laminating the third uncured layer, the second uncured layer, and the first uncured layer in this order from the cylindrical support side.

As the materials for the resin compositions to form the first hard layer, the soft layer, and the second hard layer, the same materials as the materials for known resin plates for flexography or rubber plates can be used as long as the hardness of each layer can be set within the above ranges.

In general, a resin plate for flexography or a rubber plate is prepared by forming a resin composition produced by using a polymer, a polymerization initiator, a photothermal converting agent, a solvent, and the like as materials into a sheet-like shape and then curing the resin composition by the action of heat and/or light.

Specifically, for example, the uncured relief forming layer can be formed as follows.

First, a first resin composition to form the first hard layer, a second resin composition to form the soft layer, and a third resin composition to form the second hard layer are respectively prepared.

Next, if necessary, solvents are removed from these resin compositions, and the third resin composition is melt-extruded onto a temporary support to form the third uncured layer which becomes the second hard layer. Next, the second resin composition is melt-extruded onto the third uncured layer to form the second uncured layer which becomes the soft layer. Next, the first resin composition is melt-extruded onto the second uncured layer to form the first uncured layer which becomes the first hard layer. Thus, a resin sheet having three uncured layers can be formed.

In the above-described example, the layers are formed in the order of the layer which becomes the second hard layer, the layer which becomes the soft layer, and the layer which becomes the first hard layer are formed from the temporary support side. However, the layers may be formed in the order of the layer which becomes the first hard layer, the layer which becomes the soft layer, and the layer which becomes the second hard layer from the temporary support side.

Next, the sheet-like resin sheet having three uncured layers obtained as described above can be peeled off from the temporary support and is wound around the peripheral surface of the cylindrical support to form an uncured relief forming layer. In this case, the resin sheet is placed such that the third uncured layer side thereof faces to the cylindrical support side.

Herein, in the above-described example, each uncured layer is melt-extruded to for each uncured layer, but the configuration is not limited thereto. The three uncured layers may be simultaneously formed on the temporary support by multilayer extrusion molding.

In addition, in the above-described example, each uncured layer (each resin sheet) is formed by the method of melt-extruding the resin compositions, but the configuration is not limited thereto.

For example, the resin sheet having three uncured layers may be formed by repeating an operation in which the prepared resin compositions are cast on the temporary support (or on the uncured layer) and are dried by heating in an oven or the like, and the solvents are removed to form each uncured layer.

Figure 4:
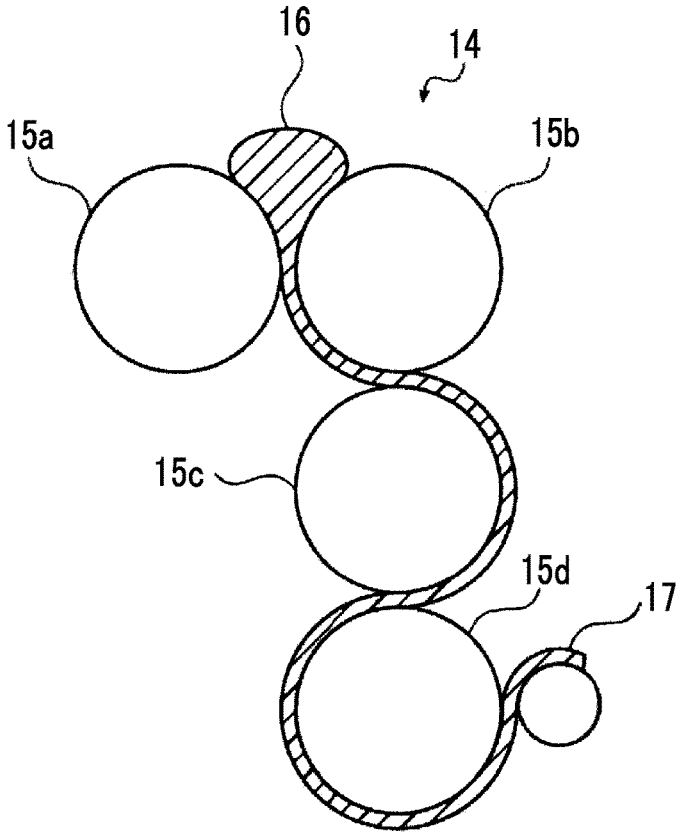
FIG. 4 is a view conceptually showing a calender roll for producing the cylindrical printing plate precursor.

Alternatively, the resin sheet having three uncured layers may be formed by molding the resin composition for each uncured layer into a sheet shape using a calender roll as shown in FIG. 4 and laminating the respective sheet-like molded uncured layers.

In FIG. 4, a calender roll 14 has a first roll 15*a* to a fourth roll 15*d* and intervals between these rolls, roll temperature, and roll rotation rate can be set. A kneaded product 16 of resin compositions is set between the rolls and molded by rolling so that a sheet-like uncured layer 17 can be obtained.

In addition, in the above-described example, the resin sheet in which each uncured layer is laminated is formed, and then the resin sheet is wound around the peripheral surface of the cylindrical support to form an uncured relief forming layer, but the configuration is not limited thereto.

For example, the first uncured layer, the second uncured layer, and the third uncured layer are respectively formed. Next, the third uncured layer is wound around the peripheral surface of the cylindrical support. Next, the second uncured layer is wound around on the third uncured layer. Further, the first uncured layer is wound on the second uncured layer. Thus, an uncured relief forming layer may be formed on the peripheral surface of the cylindrical support.

The resin sheet (uncured layer) and the cylindrical support may be bonded through a pressure sensitive adhesive layer or an adhesive layer. In this case, a resin sheet (uncured layer) in which the pressure sensitive adhesive layer or the adhesive layer is laminated may be wound around the peripheral surface of the cylindrical support. In contrast, a pressure sensitive adhesive layer or an adhesive layer may be provided on the peripheral surface of the cylindrical support and the resin sheet (uncured layer) may be wound therearound.

The peripheral surface of the cylindrical support may be subjected to a physical and/or chemical treatment to accelerate bonding between the cylindrical support and the resin sheet. Examples of the physical treatment method include a sandblasting method, a wet blasting method in which a liquid containing particles is sprayed, a corona discharge treatment method, a plasma treatment method, and a UV or vacuum UV irradiation method. Examples of the chemical treatment method include a strong acid/strong alkali treatment method, an oxidizing agent treatment method, and a coupling agent treatment method.

In the above-described example, the uncured layer or the resin sheet is once formed on the temporary support or the like, and then the uncured relief forming layer is wound around the peripheral surface of the cylindrical support. However, the configuration is not limited thereto. The uncured layer may be formed directly on the peripheral surface of the cylindrical support by extrusion molding or the like. In this case, a plurality of uncured layers may be simultaneously formed by multiple extrusion molding.

[Curing Step]

The curing step is a step of curing the uncured relief forming layer (the first uncured layer, the second uncured layer, and the third uncured layer). By curing the uncured relief forming layer, a relief forming layer having the first hard layer, the soft layer, and the second hard layer is formed.

Here, a curing method is not particularly limited as long as the uncured relief forming layer is cured by light and/or heating. A curing method used in known methods for manufacturing a cylindrical printing plate precursor can be appropriately used.

In a case where each uncured layer of the uncured relief forming layer contains a photopolymerization initiator, the uncured relief forming layer can be cured by irradiating the uncured relief forming layer with light which serves as a trigger for the photopolymerization initiator (hereinafter, also referred to as "actinic ray").

The irradiation with an actinic ray is generally performed over the entire surface of the uncured relief forming layer.

Examples of the actinic ray include visible light, ultraviolet light, and an electron beam but ultraviolet light is most generally used. In a case where the cylindrical support side of the uncured relief forming layer is taken as a rear surface, only the front surface may be irradiated with light. However, in a case where the cylindrical support is a transparent member which transmits an actinic ray, it is preferable to perform irradiation with light from the rear surface as well as from the front surface. In a case where a protective film is present, the irradiation from the front surface may be performed with the protective film being provided or may be performed after the protective film is peeled off. Since there is a concern of causing a polymerization inhibition under the presence of oxygen, the irradiation with the actinic ray may be performed after coating the uncured relief forming layer with a vinyl chloride sheet under vacuum.

In addition, in a case of photocuring, it is preferable that after the uncured relief forming layer is wound around the cylindrical support and before the uncured relief forming layer is cured, the overlapped end portions are thermally welded.

In a case where each uncured layer of the uncured relief forming layer contains a thermal polymerization initiator, each uncured layer can be cured by heating the uncured relief forming layer.

As heating means for performing curing by heat, a method of heating the uncured relief forming layer in a hot air oven or a far-infrared oven for a predetermined period of time and a method of bringing a heated roll into contact the uncured relief forming layer for a predetermined period of time may be used. Further, a method for performing curing while applying temperature and pressure like a vulcanizer is preferably used from the viewpoint of film thickness accuracy.

As a method for curing the uncured relief forming layer, from the viewpoint of being capable of uniformly curing the uncured relief forming layer from the surface to the inside thereof, a curing method using heat is preferably used.

In a case where the uncured relief forming layer is cured by heat, there are advantages in that, first, a relief formed after laser engraving is made sharp and, second, the pressure sensitive adhesiveness of engraving residue produced during the laser engraving is suppressed.

In addition, in a case where the uncured relief forming layer has an uncured layer containing a photopolymerization initiator and an uncured layer containing a thermal polymerization initiator, photocuring and thermosetting may be respectively performed.

In order to impart film thickness accuracy, it is preferable to polish the surface of the relief forming layer after the relief forming layer cured as described above is formed.

A polishing body used for surface polishing is not particularly limited and for example, a sandpaper, a polishing film, and a polishing wheel can be used.

Examples of materials for the polishing agents on the surfaces of a sandpaper and a polishing film include a metal, a ceramic, and a carbon compound. Examples of metal fine particles include fine particles of chromium, titanium, nickel, and iron. Examples of the ceramic include alumina, silica, silicon nitride, boron nitride, zirconia, zirconium silicate, and silicon carbide. Examples of the carbon compound include diamond and graphite.

Further, the material for the polishing wheel is not particularly limited and iron, alumina, a ceramic, a carbon compound, a whetstone, wood, a brush, felt, and cork may be used.

Herein, as described above, a cushion layer may be provided between the relief forming layer and the cylindrical support.

In addition, in a case where the cushion layer is attached to the outer periphery of the cylindrical support, a pressure sensitive adhesive layer or an adhesive layer may be provided on the cylindrical support side or the cushion layer side while being interposed between the cushion layer and the cylindrical support.

As described above, the cylindrical printing plate precursor of the present invention is produced.

Herein, as described above, the "relief forming layer" of the cylindrical printing plate precursor is a layer before the layer is subjected to laser engraving and is a layer for forming a relief layer having an image area and a non-image area by performing laser engraving on the relief forming layer and removing a region corresponding to the non-image area. Therefore, the surface of the relief forming layer of the cylindrical printing plate precursor of the present invention is the surface of the image area of the above-described cylindrical printing plate after laser engraving.

[Method for Manufacturing Cylindrical Printing Plate]

Next, a method for manufacturing a cylindrical printing plate of the present invention will be described in detail.

As the method for manufacturing a cylindrical printing plate of the present invention, a method in which on the cylindrical printing plate precursor produced by the method for manufacturing a cylindrical printing plate precursor, a relief forming layer in an area which becomes a non-image area by performing laser engraving imagewise is removed, and a convex image area is formed to form a relief layer having an image area and a non-image area may be used. However, the method is not limited to this method.

As an example of such an engraving step, specifically, first, the original image data of a printing plate to be produced and processing using raster image processor (RIP) is performed to convert the original image data into data for performing laser engraving.

Further, a mask treatment or the like is performed on the image data which is subjected to RIP processing to generate output image data. Laser engraving is performed using generated output image data to produce a cylindrical printing plate.

The method for laser engraving is basically the same as the method for laser engraving used in a method for manufacturing a cylindrical printing plate in the related art.

As the method for laser engraving, for example, a method in which laser light according to the output image data is emitted from the exposure head to the cylindrical printing plate precursor and the exposure head is caused to perform scanning on the printing plate precursor in a sub-scanning direction orthogonal to a main scanning direction at a predetermined pitch such that a two-dimensional image is engraved (recorded) on the surface of the printing plate precursor at a high speed and the like can be used.

The kind of laser used in the laser engraving is not particularly limited but infrared laser is preferably used. In a case where irradiation is performed with infrared laser, the molecules in the relief forming layer are vibrated to generate heat. In a case where high output laser such as carbon dioxide gas laser or yttrium aluminum garnet (YAG) laser is used as infrared laser, a large amount of heat is generated in the laser irradiation portion, the molecules in the relief forming layer are cut or ionized, and thereby, selective removal, that is, engraving is implemented. The advantage of laser engraving is that, since the depth of engraving can be set arbitrarily, it is possible to control the structure three-dimensionally. For example, in a portion on which minute halftone dots are printed, by shallowly engraving the cured layer or by engraving the cured layer with forming shoulders, it is possible to prevent the relief from being inverted due to the printing pressure. Furthermore, in a groove portion on which fine outline letters are printed, by deeply engraving the cured layer, it is possible to prevent the ink from easily filling the grooves and to inhibit the outline letters from collapsing.

Out of these, in a case where engraving is performed using an infrared laser corresponding to the absorption wavelength of a photothermal conversion agent, the relief forming layer can be selectively removed with higher sensitivity, and thus a relief layer having a sharp image is obtained.

As the infrared laser, from the viewpoint of productivity, costs, and the like, a carbon dioxide gas laser ($CO_2$ laser) or a semiconductor laser is preferable, and a semiconductor infrared laser with fiber (FC-LD) is particularly preferable. Generally, compared to the $CO_2$ laser, the semiconductor laser has higher laser oscillation efficiency, is less expensive, and can be further miniaturized. Furthermore, it is easy to make an array of the semiconductor lasers because of the small size thereof. In addition, by treating the fiber, the beam shape can be controlled.

With regard to the semiconductor laser, one having a wavelength of 700 to 1,300 nm is preferable, one having a wavelength of 800 to 1,200 nm is more preferable, one having a wavelength of 860 to 1,200 nm is even more preferable, and one having a wavelength of 900 to 1,100 nm is particularly preferable.

In addition, the semiconductor laser with fiber can output laser light efficiently by being equipped with optical fiber, and thus this is effective in the laser engraving. Further, the shape of the beam can be controlled by treatment of the fiber. For example, the beam profile may be a top hat shape, and energy can be applied stably to the plate surface. The details of semiconductor lasers are described in "Laser Handbook, 2nd Edition" edited by The Laser Society of Japan, "Applied Laser Technology" edited by The Institute of Electronics and Communication Engineers of Japan, etc.

Moreover, plate producing apparatuses including semiconductor laser constituted of fiber described in detail in JP2009-172658A and JP2009-214334A can be suitably used for the method for manufacture a cylindrical printing plate of the present invention.

Herein, in the present invention, the method for manufacturing a cylindrical printing plate is not limited to the above-described laser engraving (direct laser engraving (DLE) method) and various known manufacturing methods such as a laser ablation masking system (LAMS) method in which an image is written on the surface of a printing plate precursor by using laser and is developed can be used.

In addition, the method for manufacturing a cylindrical printing plate may further include the following rinsing step, drying step, and/or post-crosslinking step after the engraving step, if necessary:

a rinsing step: a step of rinsing the engraved surface of the relief layer after engraving with water or a liquid containing water as a main component;

a drying step: drying the engraved relief layer; and a post-crosslinking step: applying energy to the relief layer after engraving to further cure the relief layer.

Since engraving residue is attached to the engraved surface after the engraving step is performed, a rinsing step of washing off engraving residue by rinsing the engraved surface with water or a liquid containing water as a main component may be added. Examples of rinsing means include a method in which washing is performed with tap water, a method in which high pressure water is spray-jetted, and a method in which the engraved surface is brushed in the presence of mainly water using a known batch or conveyor brush type washout machine known as a developing machine of a photosensitive resin letterpress plate processor, and in a case where the slime of the engraving residue cannot removed, a rinsing liquid to which a soap or a surfactant is added may be used.

In a case where the rinsing step of rinsing the engraved surface is performed, it is preferable to add a drying step of drying an engraved relief layer so as to volatilize the rinsing liquid.

Further, if necessary, a post-crosslinking step of further curing the engraved relief layer may be added. By performing the post-crosslinking step, which is an additional curing step, it is possible to further strengthen the relief formed by engraving.

The pH of the rinsing liquid that can be used in the rinsing step is preferably 9 or higher, more preferably 10 or higher, and even more preferably 11 or higher. The pH of the rinsing liquid is preferably 14 or lower, more preferably 13.5 or lower, and even more preferably 13.1 or lower. In a case where the pH is within the above range, handling is easy. In order to make the pH of the rinsing liquid fall in the above range, the pH may be appropriately adjusted using an acid and/or a base, and the acid and base used are not particularly limited.

In addition, it is preferable that the rinsing liquid contains water as a main component. Furthermore, the rinsing liquid may contain a water-miscible solvent such as alcohols, acetone, or tetrahydrofuran as a solvent other than water.

It is preferable that the rinsing liquid contains a surfactant. As the surfactant, from the viewpoint of engraving residue removability and reducing the influence on the cylindrical printing plate, a betaine compound (amphoteric surfactant) such as a carboxybetaine compound, a sulfobetaine compound, a phosphobetaine compound, an amine oxide compound, or a phosphine oxide compound is preferably exemplified. In the present invention, the N═O structure of an amine oxide compound and the P═O structure of a phosphine oxide compound are regarded as $N^+$—$O^-$ and $P^+$—$O^-$ respectively.

Examples of the surfactant also include known anionic surfactants, canonic surfactants, amphoteric surfactants, and nonionic surfactants. Furthermore, nonionic surfactants based on fluorine and silicone can also be used.

The surfactants may be used singly or in combination of two or more kinds thereof.

The amount of the surfactant used does not need to be particularly limited. However, the amount of the surfactant used is preferably 0.01% to 20% by mass and more preferably 0.05% to 10% by mass, with respect to the total mass of the rinsing liquid.

Next, materials required for the resin compositions to form the first hard layer, the soft layer, and the second hard layer of the cylindrical printing plate precursor of the present invention will be described.

For the resin compositions to form the first hard layer, the soft layer, and the second hard layer of the cylindrical printing plate precursor, the following materials are preferable.

In order to obtain preferable hardness of each of the first hard layer, the soft layer, and the second hard layer, different materials may be used or the hardness may be adjusted by controlling the kind and the added amount of the polymerization initiator or the like. In addition, the hardness may be adjusted by controlling the amount of light irradiation at the time of curing, and temperature, heating time, and the like.

<Resin Composition>

As the resin composition, a curable resin composition containing at least a polymer having a monomer unit derived from diene-based hydrocarbon is preferable.

The resin composition used in the present invention can be manufactured by for example, dissolving or dispersing a polymer having a monomer unit derived from diene-based hydrocarbon, a polymerizable compound, aromatics, a plasticizer, and the like in an appropriate solvent and then dissolving a crosslinking agent, a polymerization initiator, a crosslinking accelerator, and the like therein. From the viewpoint of the ease of formation of the resin sheet (uncured layer), the thickness accuracy of the obtained printing plate precursor, and the handling of the resin sheet (uncured layer), at least a portion of the solvent component and preferably the almost entirety of the solvent component needs to be removed at the stage of manufacturing a printing plate precursor. Therefore, as the solvent, an organic solvent having appropriate volatility is preferable.

(Polymer Having Monomer Unit Derived from Diene-Based Hydrocarbon)

It is preferable that the resin composition used in the present invention contains a polymer having a monomer unit derived from diene-based hydrocarbon (hereinafter, also referred to as a "specific polymer") as an essential component.

The weight-average molecular weight of the specific polymer is preferably 5,000 to 1,600,000, more preferably 10,000 to 1,000,000, and even more preferably 15,000 to 600,000. In a case where the weight-average molecular weight is 5,000 or more, the shape retaining properties of the polymer as a simple resin becomes excellent. It is preferable that the weight-average molecular weight is 1,600,000 or less, because the polymer easily dissolves in a solvent, and it is easy to prepare the resin composition.

In the present invention, the weight-average molecular weight is measured by a gel permeation chromatography (GPC) and expressed in terms of standard polystyrene. Specifically, for example, for GPC, HLC-8220 GPC (manufactured by Tosoh Corporation), three columns consisting of TSKgeL Super HZM-H, TSKgeL Super HZ4000, and TSKgeL Super HZ 2000 (manufactured by Tosoh Corporation, 4.6 mm ID×15 cm), and tetrahydrofuran (THF) as an eluent are used. Furthermore, GPC is performed using an IR detector under the conditions of a sample concentration of 0.35% by mass, a flow rate of 0.35 ml/min, sample injection amount of 10 μL, and a measurement temperature of 40° C. In addition, a calibration curve is produced from 8 samples of "Standard Sample TSK standard, polystyrene" manufactured by Tosoh Corporation: "F-40", "F-20", "F-4", "F-1", "A-5000", "A-2500", "A-1000", and "n-propylbenzene".

The specific polymer may be a specific polymer having a monomer unit derived from unconjugated diene-based hydrocarbon but is preferably a specific polymer having a monomer unit derived from conjugated diene-based hydrocarbon.

(Specific Polymer Having Monomer Unit Derived from Conjugated Diene-Based Hydrocarbon)

Preferred examples of the specific polymer having a monomer unit derived from conjugated diene-based hydrocarbon include a polymer obtained by polymerizing conjugated diene-based hydrocarbon, and a copolymer obtained by polymerizing conjugated diene-based hydrocarbon with other unsaturated compounds and preferably with a monoolefin-based unsaturated compound. The above-described polymer or copolymer may be modified. For example, a reactive group such as (meth)acryloyl group may be introduced into the terminal thereof, or a portion of the internal olefin may be hydrogenated. In the following description, the polybutadiene in which a portion of the internal olefin is hydrogenated is referred to as "partially hydrogenated polybutadiene" as well, and the polyisoprene in which a portion of the internal olefin is hydrogenated likewise is referred to as "partially hydrogenated polyisoprene" as well. Further, the copolymer is not particularly limited, and may be a random polymer, a block copolymer, or a graft polymer.

Specific examples of the conjugated diene-based hydrocarbon include 1,3-butadiene, and isoprene. These compounds may be used singly or in combination of two or more kinds thereof.

Specific examples of the monoolefin-based unsaturated compounds include styrene, α-methylstyrene, o-methylstyrene, p-methylstyrene, isobutene, vinyl chloride, vinylidene chloride, (meth)acrylamide, (meth)acrylamide vinyl acetate, (meth)acrylic acid ester, and (meth)acrylic acid.

The polymer obtained by polymerizing conjugated diene-based hydrocarbon or the copolymer obtained by polymerizing conjugated diene-based hydrocarbon with a monoolefin-based unsaturated compound is not particularly limited, and specific examples thereof include a butadiene polymer, an isoprene polymer, a styrene-butadiene copolymer, a styrene-isoprene copolymer, an acrylic acid ester-isoprene copolymer, a copolymer of methacrylic acid ester and the above-described conjugated diene, an acrylonitrile-butadiene-styrene copolymer, a styrene-isoprene-styrene block copolymer, a styrene-butadiene-styrene block copolymer, and an isobutene-isoprene copolymer (butyl rubber).

These polymers may be subjected to emulsion polymerization or solution polymerization.

In the present invention, the specific polymer may have an ethylenically unsaturated group on the terminal thereof and may have a partial structure represented by the following Formula (A-1).

(A-1)

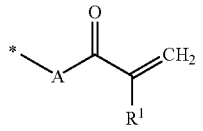

(In Formula (A-1), $R^1$ represents a hydrogen atom or a methyl group, A represents O or NH, and * represents a binding position in which the structure is bonded to other structures.)

That is, the specific polymer may have a (meth)acryloyloxy group or a (meth)acrylamide group in a molecule. The specific polymer more preferably has a (meth)acryloyloxy group in which A more preferably represents O in Formula (A-1). The term "(meth)acrylamide group" means an acrylamide group or a methacrylamide group.

The specific polymer may have the partial structure represented by Formula (A-1) on the terminal of a main chain or in a side chain. It is preferable that the specific polymer has the partial structure of the terminal of the main chain.

From the viewpoint of printing durability, it is preferable that the specific polymer has two or more partial structures represented by Formula (A-1) in a molecule.

Examples of the specific polymer having the partial structure represented by Formula (A-1) include polyolefin (meth)acrylate obtained by reacting a hydroxyl group of a hydroxyl group-containing polyolefin with an ethylenically unsaturated group-containing compound (for example, BAC-45 (manufactured by OSAKA ORGANIC CHEMICAL INDUSTRY LTD), TEA-1000, TE-2000, EMA-3000 (manufactured by NIPPON SODA CO., LTD.)), such as polybutadiene di(meth)acrylate, partially hydrogenated polybutadiene di(meth)acrylate, polyisoprene di(meth)acrylate, and partially hydrogenated polyisoprene di(meth)acrylate.

In addition, examples of the specific polymer also preferably include modified polyolefin obtained by modifying polyolefin such that an ethylenically unsaturated bond is introduced into the polyisoprene (for example, methacrylate-introduced polyolefin (KURAPRENE UC-203 and UC-102 (manufactured by KURARAY CO., LTD.)).

(Polymer Having Monomer Unit Derived from Butadiene and/or Isoprene)

In the present invention, it is preferable that the specific polymer is a polymer having a monomer unit derived from butadiene and/or isoprene.

Specific examples of the polymer include polybutadiene (butadiene rubber), partially hydrogenated polybutadiene, terminal-modified polybutadiene, polyisoprene (isoprene rubber), partially hydrogenated polyisoprene, terminal-modified polyisoprene, styrene-butadiene rubber (SBR), a styrene-butadiene-styrene triblock copolymer (SBS), an acrylonitrile-butadiene-styrene copolymer (ABS), a styrene-isoprene-styrene triblock copolymer (SIS), and an isoprene/butadiene copolymer.

The term "Terminal-modified" means that the terminal of the main chain or the side chain is modified with an amide group, a carboxyl group, a hydroxyl group, a (meth)acryloyl group, and a glycidyl group.

Among these, polybutadiene, partially hydrogenated polybutadiene, hydroxyl group-terminated polybutadiene, glycidyl ether-modified polybutadiene, polyisoprene, partially hydrogenated polyisoprene, terminal-modified polyisoprene, hydroxyl group-terminated polyisoprene, glycidyl ether-modified polyisoprene, SBS, and SIS are preferable.

The proportion of the monomer unit derived from butadiene, isoprene, or hydrogenated butadiene or isoprene is preferably 30% by mol or more in total, more preferably 50% by mol or more in total, and even more preferably 80% by mol or more in total.

It is known that isoprene is polymerized by 1,2-, 3,4-, or 1,4-addition depending on the catalyst or the reaction condition. However, in the present invention, the polyisoprene polymerized by any of the above additions may be used. From the viewpoint of obtaining desired elasticity, it is preferable that the specific polymer contains cis-1,4-polyisoprene as a main component. In a case where the specific polymer is polyisoprene, the content of the cis-1,4-polyisoprene is preferably 50% by mass or more, more preferably 65% by mass or more, even more preferably 80% by mass or more, and particularly preferably 90% by mass or more.

In addition, as the polyisoprene, natural rubber may be used and commercially available polyisoprene can be used. Examples thereof include a NIPOL IR series (manufactured by ZEON CORPORATION).

It is known that butadiene is polymerized by 1,2- or 1,4-addition depending on the catalyst or the reaction condition. However, in the present invention, the polybutadiene polymerized by any of the above additions may be used. From the viewpoint of obtaining desired elasticity, it is more preferable that the specific polymer contains 1,4-polybutadiene as a main component.

In a case where the specific polymer is polybutadiene, the content of 1,4-polybutadiene is preferably 50% by mass or more, more preferably 65% by mass or more, even more preferably 80% by mass or more, and particularly preferably 90% by mass or more.

The content of a cis-isomer or a trans-isomer is not particularly limited. From the viewpoint of expressing rubber elasticity, a cis-isomer is preferable. The content of cis-1,4-polybutadiene is preferably 50% by mass or more, more preferably 65% by mass or more, even more preferably 80% by mass or more, and particularly preferably 90% by mass or more.

As polybutadiene, commercially available products may be used and examples thereof include an NIPOL BR series (manufactured by ZEON CORPORATION), and a UBEPOL BR series (manufactured by UBE INDUSTRIES, LTD.).

(Specific Polymer Having Monomer Unit Derived from Unconjugated Diene-Based Hydrocarbon)

The specific polymer may be a specific polymer having a monomer unit derived from unconjugated diene-based hydrocarbon.

Examples of the specific polymer preferably include a copolymer obtained by polymerizing unconjugated diene-based hydrocarbon with other unsaturated compounds and preferably with an α olefin-based unsaturated compound, and the like. The copolymer is not particularly limited, and may be a random polymer, a block copolymer, or a graft polymer.

Specific examples of the unconjugated diene-based hydrocarbon include dicyclopentadiene, 1,4-hexadiene, cyclooctadiene, methylene norbornene, and ethylidene norbornene. Among these, dicyclopentadiene and ethylidene norbornene are preferable, and ethylidene norbornene is more preferable. These compounds are used singly or in combination of two or more kinds thereof.

Specific examples of the above monoolefin-based unsaturated compound include α-olefin having 2 to 20 carbon atoms such as ethylene, propylene, 1-butene, 1-hexene, and 4-methyl-pentene. Among these, ethylene and propylene are preferable. It is more preferable to use ethylene and propylene in combination. These compounds are used singly or in combination of two or more kinds thereof.

The polymer obtained by polymerizing the conjugated diene-based hydrocarbon or the copolymer obtained by polymerizing conjugated diene-based hydrocarbon with an α-olefin-based unsaturated compound is not particularly limited. As the polymer or the copolymer, an ethylene-α olefin-diene copolymer is preferable, and ethylene-propylene-diene rubber (EPDM) is more preferable.

Among the above, as the specific polymer, styrene-butadiene rubber, butadiene rubber, isoprene rubber, or ethylene-propylene-diene rubber is preferable, and butadiene rubber is more preferable.

The specific polymer is preferably a polymer in which the main chain mainly contains isoprene or butadiene as a monomer unit. Furthermore, a portion of the specific polymer may be hydrogenated and converted into a saturated bond. In addition, the middle or the terminal of the main chain of the polymer may be modified with amide, a carboxyl group, a hydroxyl group, a (meth)acryloyl group, or the like or may be epoxylated.

Among these, as the specific polymer, from the viewpoint of solubility in a solvent or handleability, polybutadiene, polyisoprene, and an isoprene/butadiene copolymer are preferably exemplified, polybutadiene and polyisoprene are more preferable, and polybutadiene is even more preferable.

From the viewpoint of expressing flexibility and rubber elasticity, the glass transition temperature (Tg) of the specific polymer is preferably 20° C. or lower.

The glass transition temperature of the specific polymer is measured according to JIS K 7121-1987 by using a differential scanning calorimeter (DSC).

In a case where the specific polymer has two or more glass transition temperatures, it is preferable that at least one of the glass transition temperatures is 20° C. or lower. It is more preferable that all of the glass transition temperatures are 20° C. or lower.

In the present invention, the SP value of the specific polymer is preferably 14.0 to 18.0 $MPa^{1/2}$, more preferably 15.0 to 17.5 $MPa^{1/2}$, and even more preferably 16.0 to 17.5 $MPa^{1/2}$.

The SP value equals the square root of cohesive energy density of a molecule. The SP value shows the magnitude of intermolecular cohesive force and is a parameter of polarity.

It is preferable that the SP value is within the above range since appropriate adhesiveness with respect to a urethane-based adhesive is obtained.

The SP value is calculated based on the Okitsu method described in The Journal of The Adhesion Society of Japan, 29(3), 1993, 204-211.

The specific polymer is preferably an elastomer or a plastomer. In a case where the specific polymer is an elastomer or a plastomer and a resin sheet (uncured layer) obtained from the specific polymer is molded into a cylindrical material, excellent thickness accuracy or dimensional accuracy can be achieved. Furthermore, it is preferable that the specific polymer is an elastomer or a plastomer since necessary elasticity can be imparted to the cylindrical printing plate.

In the present invention, the term "plastomer" means a polymer substance having properties of easily performing flow deformation by heating and of being able to be solidified into the deformed shape by cooling, as described in "New Edition of Polymer Dictionary" (The Society of Polymer Science, Japan, Asakura Publishing Co., Ltd., 1988). The term "plastomer" is a term of contrast to "elastomer" (a substance having the properties of being instantaneously deformed according to an external force in a case where an external force is applied thereto and restoring the original shape in a short time in a case where the external force is removed), and the plastomer is a substance which does not perform elastic deformation unlike the elastomer while easily performs plastic deformation.

In the present invention, the plastomer means a substance which can be deformed such that the size thereof increases up to 200% with a small external force at room temperature (20° C.) provided that the original size of the plastomer is 100, and does not shrink to such a degree that the size becomes 130% or less even in a case where the external force is removed. The small external force specifically refers to the external force at which the tensile strength becomes 1 to 100 MPa. More specifically, the plastomer means a polymer having properties in which, in a case where a dumbbell-shaped No. 4 test piece specified in JIS K 6251-1993 is used based on the tensile permanent set testing methods of JIS K 6262-1997, in a tensile test performed at 20° C., the test piece can be elongated without breakage until the distance between marked lines before the tensile test doubles, and in a case where the test piece is held as is for 60 minutes at the time when the distance between marked lines before the tensile test doubles, the external tensile force is removed, and the test piece is allowed to stand for 5 minutes, the tensile permanent set measured at this time is 30% or higher. In the present invention, all of the testing conditions are set based on the tensile permanent set testing methods of JIS K 6262-1997, except that the dumbbell-shaped No. 4 test piece specified in JIS K 6251-1993 is used, the holding time is set to be 60 minutes, and the temperature of the testing room is set to 20° C.

In a case of a polymer which cannot be measured in the above method, that is, a polymer which is deformed even in a case where an external tensile force is not applied thereto and does not restore its original shape in a tensile test or a polymer which is broken in a case where the small external force used at the time of measurement described above is applied thereto corresponds to the plastomer.

Further, in the present invention, the glass transition temperature (Tg) of the polymer plastomer is lower than 20° C. In a case where the polymer has two or more Tg's, all of Tg's are lower than 20° C. Tg of the polymer can be measured by differential scanning calorimetry (DSC).

In the present invention, the term "elastomer" means a polymer which can be elongated until the distance between marked lines doubles in the above tensile test and having a tensile permanent set of less than 30% as measured 5 minutes after the external tensile force is removed.

The viscosity of the specific polymer of the present invention at 20° C. is preferably 10 Pa·s to 10 kPa·s and more preferably 50 Pa·s to 5 kPa·s. In a case where the viscosity is within the above range, the resin composition is easily molded into a sheet-shaped material, and the process is simplified. In the present invention, in a case where the specific polymer is a plastomer and the resin composition is molded into a sheet-shaped material, excellent thickness accuracy or dimensional accuracy can be achieved.

In the present invention, the specific polymer may be used singly or in combination of two or more kinds thereof.

The total content of the specific polymer in the resin composition used in the present invention is preferably 5% to 90% by mass, more preferably 15% to 85% by mass, and even more preferably 30% to 80% by mass with respect to the total mass of the solid content of the resin composition.

In a case where the content of the specific polymer is 5% by mass or more, printing durability sufficient for using the resin sheet obtained from the obtained resin composition as a printing plate is obtained. In a case where the content of the specific polymer is 90% by mass or less, the amount of other components does not become insufficient, and also in a case where the resin sheet is used as a printing plate, sufficient flexibility can be obtained.

The term "total mass of the solid content" means the total mass determined in a case where volatile components such as a solvent are excluded from the resin composition.

In the present invention, it is preferable that the resin composition to form the first hard layer of the relief forming layer is a crystalline polymer from the viewpoint of ease of formation of the relief forming layer and hardness. Since the fluidity of the crystalline polymer at the time of heating becomes high, a cylindrical printing plate precursor and a cylindrical printing plate having a high leveling effect and high film thickness accuracy can be obtained. The fluidity at the time of heating can be expressed by a melt index (MI:ASTM D1238) or an index for a melt flow rate (MFR: JIS K7210).

Herein, the term "crystalline polymer" means a polymer in which crystalline regions in which long-chain molecules are regularly arranged and amorphous regions in which long-chain molecules are not regularly arranged are mixed in the molecular structure, and refers to a polymer having a crystallinity of 1 vol % or more, which is the ratio of the crystalline region, at 25 degrees.

In addition, regarding the crystallinity, while the temperature is being changed with a differential scanning calorimeter at a temperature rising rate of 20° C./min in a range of 25° C. to 200° C. in a nitrogen atmosphere, a heat absorption peak (ΔH (J/g)) by crystal melting is obtained. Based on the measured ΔH, a reaching crystallinity (%) is calculated by the following equation.

$$\text{Crystallinity (\%)}=\{\Delta H/a\}\times 100$$

In the equation, "a" denotes a heat of crystal melting in a case where the component of the crystalline region shown in a known document is 100% crystallized (for example, in a case of polylactic acid, 94 J/g, and in a case of polyethylene (HDPE), 293 (J/g)).

Examples of the crystalline polymer include a polybutadiene-based thermoplastic elastomer, and a polyolefin-based thermoplastic elastomer. Specific examples thereof include polystyrene-polybutadiene (SB), polystyrene-polybutadiene-polystyrene (SBS), polystyrene-polyisoprene-polystyrene (SIS), polystyrene-polyethylene/polybutylene-polystyrene (SEBS), an acrylonitrile-butadiene-styrene copolymer (ABS), acrylic ester rubber (ACM), an acrylonitrile-chlorinated polyethylene-styrene copolymer (ACS), amorphous polyalphaolefin, atactic polypropylene, an acrylonitrile styrene copolymer, cellulose acetate butyrate, cellulose acetate propionate, an ethylene-vinyl acetate copolymer, ethyl vinyl ether, polyacrylic acid, polypropylene, syndiotactic 1,2-polybutadiene, polyisoprene, polyoctenylene, trans-polyisoprene, polyvinyl butyral, an ethylene-α-olefin copolymer such as an ethylene-octene copolymer, a propylene-α-olefin copolymer, and a 1,3-pentadiene polymer.

Among these, SBS, SIS, SEBS, polypropylene, syndiotactic 1,2-polybutadiene, polyisoprene, polyoctenylene, trans-polyisoprene, an ethylene-α-olefin copolymer such as an ethylene-octene copolymer, and a propylene-α-olefin copolymer are preferable and among these, syndiotactic 1,2-polybutadiene, an ethylene-α-olefin copolymer, a propylene-α-olefin copolymer, and polyoctenylene are particularly preferable.

It is preferable that the resin composition used in the present invention contains a polymerization initiator, a photothermal conversion agent, a solvent, and other components. Hereinafter, these components will be described.

(Polymerization Initiator)

The resin composition in the present invention is preferably formed using a resin composition containing a polymerization initiator. In a case where the resin composition contains a polymerization initiator, the crosslinking of the specific polymer and the ethylenically unsaturated bonds contained in the polymerizable compound, which will be described later, is accelerated.

As the polymerization initiator, the compounds known to those in the related art can be used without limitation. Although any of a photopolymerization initiator and a thermal polymerization initiator can be used, a thermal polymerization initiator is preferable since the compound makes it possible to form a crosslink by using a simple device. Hereinafter, a radical polymerization initiator as a preferable polymerization initiator will be specifically described, but the present invention is not limited thereto.

In the present invention, examples of preferable polymerization initiators include (a) aromatic ketones, (b) onium salt compound, (c) organic peroxide, (d) thio compound, (e) hexaarylbiimidazole compound, (f) keto oxime ester compound, (g) borate compound, (h) azinium compound, (i)

metallocene compound, (j) active ester compound, (k) carbon-halogen bond-containing compound, and (l) azo-based compound. Hereinafter, although specific examples of the (a) to (l) will be shown below, but the present invention is not limited thereto.

In the present invention, from the viewpoint of improving the engraving sensitivity and the relief edge shape, (c) organic peroxide and (l) azo-based compound are more preferable, and (c) organic peroxide is particularly preferable.

Regarding (a) aromatic ketones, (b) onium salt compound, (d) thio compound, (e) hexaarylbiimidazole compound, (f) keto oxime ester compound, (g) borate compound, (h) azinium compound, (i) metallocene compound, (j) active ester compound, and (k) carbon-halogen bond-containing compound described above, the compounds described in paragraphs 0074 to 0118 of JP2008-63554A can be preferably used.

In addition, as (c) organic peroxide and (l) azo-based compound, the following compounds are preferable.

(c) Organic Peroxide

As (c) organic peroxide which is preferable as the thermal polymerization initiator that can be used in the present invention, peroxyester-based compounds such as 3,3' 4,4'-tetra(t-butylperoxycarbonyl)benzophenone, 3,3' 4,4'-tetra(t-amylperoxycarbonyl)benzophenone, 3,3'4,4'-tetra(t-hexylperoxycarbonyl)benzophenone, 3,3' 4,4'-tetra(t-octylperoxycarbonyl)benzophenone, 3,3'4,4'-tetra(cumylperoxycarbonyl)benzophenone, 3,3'4,4'-tetra(p-isopropylcumylperoxycarbonyl)benzophenone, di-t-butyldiperoxyisophthalate, t-butylperoxybenzoate, t-butylperoxy-3-methylbenzoate, t-butylperoxylaurate, t-butylperoxypivalate, t-butylperoxy-2-ethylhexanoate, t-butylperoxy-3,5,5-trimethylhexanoate, t-butylperoxyneoheptanoate, t-butylperoxyneodecanoate, t-butylperoxyacetate, α,α'-di(t-butylperoxy)diisopropylbenzene, dicumyl peroxide, t-butylcumylperoxide, di-t-butylperoxide, t-butylperoxyisopropylmonocarbonate, and t-butylperoxy-2-ethylhexylmonocarbonate are preferable. Among these, from the viewpoint of excellent compatibility, t-butylperoxybenzoate is particularly preferable.

(l) Azo-Based Compound

Examples of (l) azo-based compound which is preferable as the polymerization initiator that can be used in the present invention include 2,2'-azobisisobutyronitrile, 2,2'-azobispropionitrile, 1,1'-azobis(cyclohexane-1-carbonitrile), 2,2'-azobis(2-methylbutyronitrile), 2,2'-azobis(2,4-dimethylvaleronitrile), 2,2'-azobis(4-methoxy-2,4-dimethylvaleronitrile), 4,4'-azobis(4-cyanovalerate), dimethyl 2,2'-azobisisobutyrate, 2,2'-azobis(2-methylpropionamidoxime), 2,2'-azobis[2-(2-imidazolin-2-yl)propane], 2,2'-azobis {2-methyl-N-[1,1-bis(hydroxymethyl)-2-hydroxyethyl]propionamide}, 2,2'-azobis [2-methyl-N-(2-hydroxyethyl)propionamide], 2,2'-azobis(N-butyl-2-methylpropionamide), 2,2'-azobis(N-cyclohexyl-2-methylpropionamide), 2,2'-azobis[N-(2-propenyl)-2-methylpropionamide], and 2,2'-azobis(2,4,4-trimethylpentane).

In the present invention, from the viewpoint of improving the curing properties of the resin sheet and the engraving sensitivity, (c) organic peroxide described above is particularly preferred as the polymerization initiator used in the present invention.

From the viewpoint the engraving sensitivity, an aspect is particularly preferable in which (c) organic peroxide is combined with the photothermal conversion agent which will be described later.

In a case where the uncured relief forming layer (uncured layer) is thermally cured by using an organic peroxide, the unreacted organic peroxide not being involved in the generation of a radical remains. However, the remaining organic peroxide functions as a self-reactive additive and is decomposed in an exothermic manner at the time of laser engraving. As a result, it is assumed that thermal decomposition is added to the radiated laser energy, and thus the engraving sensitivity is improved.

The effect is remarkably exhibited in a case where carbon black is used as the photothermal conversion agent, although the mechanism will be specifically explained later in the description of the photothermal conversion agent. It is considered that the heat generated from carbon black may also be transferred to (c) organic peroxide, as a result, the heat may be released not only from carbon black but also from the organic peroxide, and thus the thermal energy supposed to be used for the decomposition of the specific polymer or the like may be synergistically generated.

In the present invention, only one kind of polymerization initiator may be used, or two or more kinds thereof may be used in combination.

The content of the polymerization initiator in the resin composition used in the present invention is preferably 0.01% to 30% by mass, more preferably 0.1% to 20% by mass, and even more preferably 1% to 15% by mass with respect to the total mass of the solid content. It is preferable that the content is within the above range, since the curing properties become excellent, the relief edge shape obtained in a case of laser engraving becomes excellent, and the rinsability become excellent.

(Photothermal Conversion Agent)

It is preferable that the resin composition used in the present invention further contains a photothermal conversion agent. That is, it is considered that, by absorbing the laser light and releasing heat, the photothermal conversion agent in the present invention accelerates the thermal decomposition of the cured product at the time of laser engraving. Therefore, it is preferable to select a photothermal conversion agent that absorbs light having the wavelength of the laser used for engraving.

In a case where a laser (a YAG laser, a semiconductor laser, a fiber laser, a surface emitting laser, or the like) emitting infrared rays at 700 to 1,300 nm is used as a light source for laser-engraving the relief forming layer of the cylindrical printing plate precursor of the present invention, it is preferable to use a compound having a maximum absorption wavelength at 700 to 1,300 nm as the photothermal conversion agent.

In the present invention, various dyes or pigments are used as the photothermal conversion agent.

With regard to the photothermal conversion agent, examples of dyes that can be used include commercial dyes and known dyes described in publications such as "Senryo Binran" (Dye Handbook) (Ed. by The Society of Synthetic Organic Chemistry, 1970). Specific examples include dyes having a maximum absorption wavelength at 700 to 1,300 nm, and dyes such as azo dyes, metal complex salt azo dyes, pyrazolone azo dyes, naphthoquinone dyes, anthraquinone dyes, phthalocyanine dyes, carbonium dyes, diimmonium compounds, quinone imine dyes, methine dyes, cyanine dyes, squarylium colorants, pyrylium salts, and metal thiolate complexes are preferably used. As the dye that can be preferably used in the present invention, cyanine-based colorants such as heptamethine cyanine colorants, oxonol-based colorants such as pentamethine oxonol colorants, phthalocyanine-based colorants, and dyes described in paragraphs 0124 to 0137 of JP2008-63554A may be used.

Among the photothermal conversion agents used in the present invention, pigments including commercial pigments and pigments described in the Color Index (C.I.) Handbook, "Saishin Ganryo Binran" (Latest Pigments Handbook) (Ed. by Nippon Ganryo Gijutsu Kyokai, 1977), "Saisin Ganryo Ouyogijutsu" (Latest Applications of Pigment Technology) (CMC Publishing, 1986), "Insatsu Inki Gijutsu" (Printing Ink Technology) CMC Publishing, 1984) can be used. Examples of the pigments include pigments described in paragraphs 0122 to 0125 of JP2009-178869A.

Among these pigments, carbon black is preferable.

Any kind of carbon black including those graded by ASTM can be used regardless of the purpose (for example, carbon black for coloring, rubber, batteries, and the like) as long as the dispersibility thereof in the composition is stable. Carbon black includes, for example, furnace black, thermal black, channel black, lamp black, and acetylene black. Herein, a black colorant such as carbon black is easily dispersed. Therefore, if necessary, carbon black can be used in the form of a color chip or color paste obtained by dispersing the pigment in nitrocellulose, a binder, or the like in advance using a dispersant. The chip or paste is easily available as commercial products. Examples of carbon black also include those described in paragraphs 0130 to 0134 in JP2009-178869A.

In the resin composition used in the present invention, only one kind of photothermal conversion agent may be used or two or more kinds thereof may be used in combination.

The content of the photothermal conversion agent in the resin composition greatly varies with the magnitude of a molecular extinction coefficient inherent to the molecule of the photothermal conversion agent. However, The content of the photothermal conversion agent in the resin composition is preferably within a range of 0.01% to 30% by mass, more preferably 0.05% to 20% by mass, and particularly preferably 0.1% to 10% by mass of the total mass of the solid content.

(Solvent)

The resin composition used in the present invention may contain a solvent.

It is preferable to use an organic solvent as the solvent.

Preferable specific examples of aprotic organic solvents include acetonitrile, tetrahydrofuran, dioxane, toluene, propylene glycol monomethyl ether acetate, methyl ethyl ketone, acetone, methyl isobutyl ketone, ethyl acetate, butyl acetate, ethyl lactate, N,N-dimethylacetamide, N-methylpyrrolidone, and dimethyl sulfoxide.

Preferable specific examples of organic protic solvents include methanol, ethanol, 1-propanol, 2-propanol, 1-butanol, 1-methoxy-2-propanol, ethylene glycol, diethylene glycol, and 1,3-propanediol.

Among these, propylene glycol monomethyl ether acetate can be particularly preferably exemplified.

(Other Additives)

In the resin composition used in the present invention, various known additives can be appropriately incorporated to the extent that the effects of the present invention are not impaired. Examples thereof include a crosslinking agent, a crosslinking accelerator, a plasticizer, a filler, a wax, a process oil, a metal oxide, an ozone decomposition preventing agent, an aging inhibitor, a polymerization inhibitor and a colorant, and these may be used singly or in combination of two or more kinds thereof.

(Polymerizable Compound)

In order to accelerate the formation of a cross-linked structure, the resin sheet (uncured layer) used in the present invention can be formed using the resin composition containing a polymerizable compound. In a case where the resin composition contains a polymerizable compound, the formation of a cross-linked structure is accelerated, and the printing durability of the obtained printing plate becomes excellent.

In addition, the above-described specific polymer having an ethylenically unsaturated group is not included in the polymerizable compound.

Further, the polymerizable compound is preferably a compound having a molecular weight less than 3,000, and more preferably a compound having a molecular weight less than 1,000.

The polymerizable compound is preferably a radically polymerizable compound or an ethylenically unsaturated compound.

The polymerizable compound used in the present invention is preferably a polyfunctional ethylenically unsaturated compound. In a case where the above aspect is adopted, the printing durability of the obtained printing plate is further improved.

As the polyfunctional ethylenically unsaturated compound, the compounds having 2 to 20 ethylenically unsaturated groups on the terminal are preferable. A group of these compounds is widely known in the field of the related art and can be used in the present invention without particular limitation.

Examples of compounds from which the ethylenically unsaturated group in the polyfunctional ethylenically unsaturated compound is derived include unsaturated carboxylic acid (for example, acrylic acid, methacrylic acid, itaconic acid, crotonic acid, isocrotonic acid, or maleic acid) and esters or amides thereof. Among these, esters of unsaturated carboxylic acid and an aliphatic polyhydric alcohol compound and amides of unsaturated carboxylic acid and an aliphatic polyvalent amine compound are preferably used. Further, a product of an addition reaction between an unsaturated carboxylic acid ester having a nucleophilic substituent such as a hydroxyl group or an amino group, amides, polyfunctional isocyanates, and epoxies, a product of a dehydrocondensation reaction with polyfunctional carboxylic acid, and the like are also suitably used. In addition, a product of an addition reaction between an unsaturated carboxylic acid ester having an electrophilic substituent such as an isocyanate group or an epoxy group, amides, monofunctional or polyfunctional alcohols, and amines, and a product of a substitution reaction between an unsaturated carboxylic acid ester having a leaving substituent such as a halogen group or a tosyloxy group, amides, monofunctional or polyfunctional alcohols, and amines are also suitable. As another example, instead of the above unsaturated carboxylic acid, it is possible to use a group of compounds substituted with a vinyl compound, an allyl compound, unsaturated phosphonic acid, styrene, or the like.

From the viewpoint of reactivity, the ethylenically unsaturated group included in the polymerizable compound is preferably each residue of acrylate, methacrylate, a vinyl compound, and an allyl compound. In addition, from the viewpoint of printing durability, the polyfunctional ethylenically unsaturated compound more preferably has 3 or more ethylenically unsaturated groups.

Specific examples of monomers of esters of an aliphatic polyhydric alcohol compound and unsaturated carboxylic acid include acrylic acid esters such as ethylene glycol diacrylate, diethylene glycol diacrylate, triethylene glycol diacrylate, polyethylene glycol diacrylate, 1,3-butanediol diacrylate, tetramethylene glycol diacrylate, propylene glycol diacrylate, dipropylene glycol diacrylate, tripropylene glycol diacrylate, polypropylene glycol diacrylate, neopentyl glycol diacrylate, 1,6-hexanediol diacrylate, 1,4-cyclohexanediol diacrylate, tetraethylene glycol diacrylate, polytetramethylene glycol diacrylate, 1,8-octanediol diacrylate, 1,9-nonanediol diacrylate, 1,10-decanediol diacrylate, tricyclodecanedimethanol diacrylate, trimethylolpropane triacrylate, trimethylolpropane tri(acryloyloxypropyl)ether, ditrimethylolpropane tetraacrylate, trimethylolethane triacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, and a polyester acrylate oligomer.

Specific examples of the monomers include methacrylic acid esters such as tetramethylene glycol dimethacrylate, ethylene glycol dimethacrylate, diethylene glycol dimethacrylate, triethylene glycol dimethacrylate, polyethylene glycol dimethacrylate, propylene glycol dimethacrylate, dipropylene glycol dimethacrylate, tripropylene glycol dimethacrylate, polypropylene glycol dimethacrylate, neopentyl glycol dimethacrylate, trimethylolpropane trimethacrylate, trimethylolethane trimethacrylate, 1,3-butanediol dimethacrylate, 1,6-hexanediol dimethacrylate, 1,8-octanediol dimethacrylate, 1,9-nonanediol dimethacrylate, 1,10-decanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)phenyl]dimethyl methane, and bis[p-(methacryloxyethoxy)phenyl]dimethyl methane. Among these, trimethylolpropane trimethacrylate and polyethylene glycol dimethacrylate are particularly preferable.

Specific examples of the monomers include itaconic acid esters such as ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate.

Specific examples of the monomers include crotonic acid esters such as ethylene glycol dicrotonate, tetramethylene glycol dicrotonate, pentaerythritol dicrotonate, and sorbitol tetracrotonate.

Specific examples of the monomers include isocrotoinc acid esters such as ethylene glycol diisocrotonate, pentaerythritol diisocrotonate, and sorbitol tetraisocrotonate.

Specific examples of the monomers include maleic acid esters such as ethylene glycol dimaleate, triethylene glycol dimaleate, pentaerythritol dimaleate, and sorbitol tetramaleate.

As other esters, for example, the aliphatic alcohol-based esters described in JP1971-27926B (JP-S46-27926B), JP1976-47334B (JP-S51-47334B), and JP1982-196231A (JP-557-196231A), the esters having an aromatic skeleton described in JP1984-5240A (JP-559-5240A), JP1984-5241A (JP-S59-5241A), and JP1990-226149A (JP-H02-226149A), the amino group-containing esters described in JP1989-165613A (JP-H01-165613A), and the like are suitably used.

The ester monomers can also be used as a mixture.

Specific examples of monomers of an amide of an aliphatic polyvalent amine compound and unsaturated carboxylic acid include methylene bisacrylamide, methylene bismethacrylamide, 1,6-hexamethylenebis-acrylamide, 1,6-hexamethylenebismethacrylamide, diethylene triamine trisacrylamide, xylylene bisacrylamide, and xylylene bismethacrylamide.

Examples of preferable other amide-based monomers include monomers having a cyclohexylene structure described in JP1979-21726B (JP-554-21726B).

In addition, a urethane-based addition polymerizable compound manufactured using an addition reaction of isocyanate and a hydroxyl group is also suitable. Specific examples of the compound include a vinyl urethane compound containing 2 or more polymerizable vinyl groups in one molecule that is obtained by adding a hydroxyl group-containing vinyl monomer represented by the following Formula (i) to a polyisocyanate compound having 2 or more isocyanate groups in one molecule that is described in JP1973-41708B (JP-548-41708B).

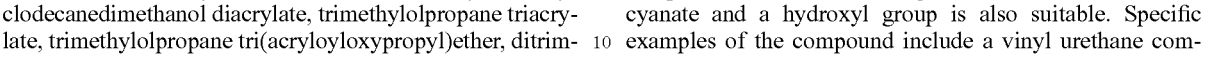

$$CH_2{=}C(R)COOCH_2CH(R')OH \quad (i)$$

(where R and R' each represent H or $CH_3$.)

In addition, urethane acrylates described in JP1976-37193A (JP-S51-37193A), JP1990-32293B (JP-H02-32293B), and JP1990-16765B (JP-H02-16765B) and urethane compounds having an ethylene oxide-based skeleton described in JP1983-49860B (JP-S58-49860B), JP1981-17654B (JP-S56-17654B), JP1987-39417B (JP-S62-39417B), and JP1987-39418B (JP-S62-39418B) are also suitable.

Further, by using addition polymerizable compounds having an amino structure in a molecule described in JP1988-277653A (JP-S63-277653A), JP1988-260909A (JP-S63-260909A), and JP1989-105238A (JP-H01-105238A), a relief forming layer can be obtained in a short period of time.

Examples of the monomers also include polyfunctional acrylate or methacrylate such as the polyester acrylates described in JP1973-64183A (JP-S48-64183A), JP1974-43191B (JP-S49-43191B), and JP1977-30490B (JP-S52-30490B) and epoxy acrylates obtained by reacting an epoxy resin with (meth)acrylic acid. Examples of the monomers also include specific unsaturated compounds described in JP1971-43946B (JP-S46-43946B), JP1989-40337B (JP-H01-40337B), and JP1989-40336B (JP-H01-40336B), the vinyl phosphonate-based compound described in JP1990-25493A (JP-H02-25493A). In some cases, the structure containing a perfluoroalkyl group described in JP1986-22048A (JP-S61-22048A) is suitably used. Further, it is possible to use those introduced as photocurable monomers and oligomers in The Journal of The Adhesion Society of Japan, vol. 20, No. 7, pp 300-308 (1984).

Examples of the vinyl compound include butanediol-1,4-divinyl ether, ethylene glycol divinyl ether, 1,2-propanediol divinyl ether, 1,3-propanediol divinyl ether, 1,3-butanediol divinyl ether, 1,4-butanediol divinyl ether, neopentyl glycol divinyl ether, trimethylolpropane trivinyl ether, trimethylolethane trivinyl ether, hexanediol divinyl ether, tetraethylene glycol divinyl ether, pentaerythritol divinyl ether, pentaerythritol trivinyl ether, pentaerythritol tetravinyl ether, sorbitol tetravinyl ether, sorbitol pentavinyl ether, ethylene glycol diethylene vinyl ether, ethylene glycol dipropylene vinyl ether, trimethylolpropane triethylene vinyl ether, trimethylolpropane diethylene vinyl ether, pentaerythritol diethylene vinyl ether, pentaerythritol triethylene vinyl ether, pentaerythritol tetraethylene vinyl ether, 1,1,1-tris[4-(2-vinyloxyethoxy)phenyl]ethane, bisphenol A divinyloxyethyl ether, and divinyl adipate.

In the resin composition used in the present invention, only one kind of polymerizable compound may be used or two or more kinds thereof may be used in combination.

The content of the polymerizable compound in the resin composition used in the present invention is preferably 0.1% to 30% by mass, more preferably 0.5% to 20% by mass, and even more preferably 1% to 10% by mass with respect to the total mass of the solid content of the resin composition. In a case of the relief forming layer formed of a resin composition within the above range, the rinsability of engraving residue generated at the time of laser engraving is further improved, and the printing durability of the obtained printing plate is further improved.

(Formulation Amount of Each Component)

The total content of the specific polymer in the resin composition is preferably 5% to 90% by mass with respect to the total mass of the solid content of the resin composition used in the present invention, the content of the polymerization initiator is preferably 0.01% to 30% by mass, the content of the photothermal conversion agent is preferably in a range of 0.01% to 30% by mass, and the content of the polymerizable compound is preferably 0% to 30% by mass.

[Flexographic Printing Apparatus]

Next, the configuration of a flexographic printing apparatus (hereinafter, also simply referred to as a "printing apparatus") using the cylindrical printing plate according to the present invention will be described in detail. Except for using the cylindrical printing plate described above, the printing apparatus basically has the same constitution as the printing apparatus of the related art.

Figure 5:
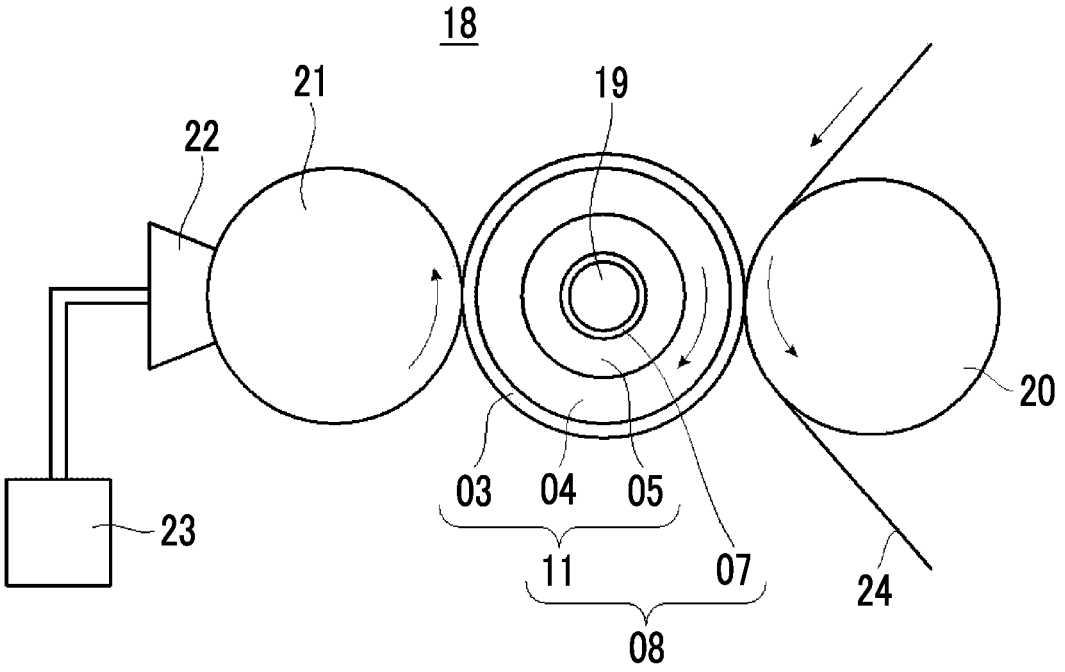
FIG. 5 is a view conceptually showing a main part of a printing apparatus using the cylindrical printing plate according to the present invention.

FIG. 5 is a view conceptually showing a main part of a printing apparatus using the cylindrical printing plate according to the present invention.

As shown in FIG. 5, a printing apparatus 18 has the cylindrical printing plate 08, a rotation axis 19, a transport roller (impression cylinder) 20, an anilox roller 21, a doctor chamber 22, and a circulation tank 23.

The rotation axis 19 is a rotatable cylindrical member and is inserted into a cylindrical support 07 of the cylindrical printing plate 08 to rotatably fix the cylindrical printing plate 08. In addition, the rotation axis 19 is arranged at a position where the surface of the cylindrical printing plate 08 (the surface of the relief layer 11) is brought into contact with an object to be printed 24 wound around the transport roller 20.

The transport roller 20 is a roller constituting a transport portion (not shown in the drawing) which transports the object to be printed 24 along a predetermined transport path. The transport roller 20 is arranged such that the peripheral surface thereof face the peripheral surface of the cylindrical printing plate 08 and brings the object to be printed 24 into contact with the cylindrical printing plate 08.

In addition, the rotation axis 19 is arranged such that the rotation direction thereof is matched with the transport direction of the object to be printed 24.

The anilox roller 21, the doctor chamber 22, and the circulation tank 23 are portions for supplying ink to the cylindrical printing plate 08. The circulation tank 23 stores ink, and the ink in the circulation tank 23 is supplied to the doctor chamber 22 by a pump (not shown in the drawing). The doctor chamber 22 is arranged to come into close contact with the surface of the anilox roller 21 and holds ink in the inside thereof. The anilox roller 21 rotates in synchronization with the cylindrical printing plate 08 in a state of abutting on the peripheral surface of the cylindrical printing plate 08, such that the cylindrical printing plate 08 is coated (supplied) with the ink in the doctor chamber 22.

While transporting the object to be printed 24 along a predetermined transport path, the printing apparatus 18 having the above configuration rotates the cylindrical printing plate fixed to the rotation axis 19 and transfers the ink to the object to be printed 24, thereby performing printing. That is, the rotation direction of the rotation axis onto which the cylindrical printing plate is fixed becomes the printing direction.

The kind of the object to be printed used in the printing apparatus using the cylindrical printing plate of the present invention is not particularly limited and various known objects to be printed used in general printing apparatuses, such as paper, films, and cardboards, can be used.

In addition, the kind of the ink used in the printing apparatus using the cylindrical printing plate of the present invention is not particularly limited and various known inks used in general printing apparatuses, such as an aqueous ink, an UV ink, an oil ink, and an EB ink, can be used.

EXAMPLES

Hereinafter, the present invention will be more specifically described using examples. However, the present invention is not limited thereto.

In the examples, unless otherwise specified, a number average molecular weight (Mn) and a weight-average molecular weight (Mw) of a polymer represent values measured by a GPC method.

In addition, in the following description, unless otherwise specified, "part(s)" means "part(s) by mass", and "%" means "% by mass".

Example 1

[Production of Cylindrical Printing Plate Precursor]

<Preparation of Resin Composition>

(Preparation of Resin Composition A to Form First Hard Layer of Relief Forming Layer)

Using an MS type small pressurizing kneader (manufactured by MORIYAMA CO., LTD.) 100 parts by mass of syndiotactic 1,2-polybutadiene RB820 (manufactured by JSR Corporation) as a crystalline polymer, and 12 parts by mass of CARBON BLACK #45L (average particle diameter: 24 nm, relative surface area: 125 $m^2/g$, manufactured by Mitsubishi Chemical Corporation) as carbon black were kneaded for 10 minutes at 80° C. with a front blade at 35 rpm and a rear blade at 35 rpm and then the kneaded product was cooled to 60° C. 1.5 parts by mass of PERCUMYL D-40 (organic peroxide, dicumyl peroxide (40% by mass), manufactured by NOF CORPORATION) as a thermal polymerization initiator was added thereto, and kneaded for 10 minutes at 60° C. with a front blade at 20 rpm and a rear blade at 20 rpm to prepare a resin composition A to form a first hard layer of a relief forming layer.

(Preparation of Resin Composition B to Form Soft Layer of Relief Forming Layer)

Using an MS type small pressurizing kneader, 100 parts by mass of JSR EP24 (ethylene propylene rubber, number average molecular weight: 500,000 or more, manufactured by JSR Corporation) as a polymer, and 12 parts by mass of CARBON BLACK #45L were kneaded for 10 minutes at 80° C. with a front blade at 35 rpm and a rear blade at 35 rpm and then the kneaded product was cooled to 60° C. 2 parts by mass of PERCUMYL D-40 was added thereto and kneaded for 10 minutes at 60° C. with a front blade at 20 rpm and a rear blade at 20 rpm to prepare a resin composition B to form a soft layer of a relief forming layer.

(Preparation of Resin Composition C to Form Second Hard Layer of Relief Forming Layer)

Using an MS type small pressurizing kneader, 100 parts by mass of BR150L (solid polybutadiene, number average molecular weight: 470,000, manufactured by UBE INDUSTRIES, LTD, hereinafter, referred to as "BR") as a polymer and 12 parts by mass of CARBON BLACK #45L were kneaded for 10 minutes at 80° C. with a front blade at 35 rpm and a rear blade at 35 rpm and then the kneaded product was cooled to 60° C. 14 parts by mass of PERCUMYL D-40 was added thereto and kneaded for 10 minutes at 60° C. with a front blade at 20 rpm and a rear blade at 20 rpm to prepare a resin composition C to form a second hard layer of a relief forming layer.

<Formation of Uncured Relief Forming Layer>

(Production of Uncured Layer A)

The resin composition A obtained as above was molded into a sheet-like shape by using calender rolls (4 inverted L-shaped rolls manufactured Nippon Roll MFG Co., Ltd.). By heating warm-up rolls to 50° C., the resin composition A was preliminarily kneaded for 10 minutes. The kneaded product wound around the roll was cut in the process of kneading, drawn in the form of a sheet, and once rolled up. Thereafter, the kneaded product was set between the first calender roll and the second calender roll and molded by rolling. The temperature of each of the calender rolls was set such that the first roll had a temperature of 50° C., the second roll had a temperature of 60° C., the third roll had a temperature of 70° C., and the fourth roll had a temperature of 80° C. Regarding the roll interval, the interval between the first and second rolls was set to be 1.0 mm, the interval between the second and third rolls was set to be 0.4 mm, and the interval between the third and fourth rolls was set to be 0.2 mm. The transport rate was set to be 1 m/min.

After passing through the fourth roll, the sheet was cut to have a width of 20 cm and thus an uncured layer A was obtained.

(Production of Uncured Layer B)

The resin composition B obtained as above was molded into a sheet-like shape by using calender rolls. By heating warm-up rolls to 50° C., the resin composition B was preliminarily kneaded for 10 minutes. The kneaded product wound around the roll was cut in the process of kneading, drawn in the form of a sheet, and once rolled up. Thereafter, the kneaded product was set between the first calender roll and the second calender roll and molded by rolling. The temperature of each of the calender rolls was set such that the first roll had a temperature of 50° C., the second roll had a temperature of 60° C., the third roll had a temperature of 70° C., and the fourth roll had a temperature of 80° C. Regarding the roll interval, the interval between the first and second rolls was set to be 2.0 mm, the interval between the second and third rolls was set to be 1.5 mm, and the interval between the third and fourth rolls was set to be 1.2 mm. The transport rate was set to be 1 m/min.

After passing through the fourth roll, the sheet was cut to have a width of 20 cm and thus an uncured layer B was obtained.

(Production of Uncured Layer C)

The resin composition C obtained as above was molded into a sheet-like shape by using calender rolls. By heating warm-up rolls to 50° C., the resin composition C was preliminarily kneaded for 10 minutes. The kneaded product wound around the roll was cut in the process of kneading, drawn in the form of a sheet, and once rolled up. Thereafter, the kneaded product was set between the first calender roll and the second calender roll and molded by rolling. The temperature of each of the calender rolls was set such that the first roll had a temperature of 50° C., the second roll had a temperature of 60° C., the third roll had a temperature of 70° C., and the fourth roll had a temperature of 80° C. Regarding the roll interval, the interval between the first and second rolls was set to be 6.0 mm, the interval between the second and third rolls was set to be 5.0 mm, and the interval between the third and fourth rolls was set to be 4.2 mm. The transport rate was set to be 1 m/min.

After passing through the fourth roll, the sheet was cut to have a width of 20 cm and thus an uncured layer C was obtained.

The uncured layers A, B, and C obtained as above were placed on the peripheral surface of a cylindrical support of an external diameter of 108 mm such that the uncured layers C, B, and A were arranged in this order from the cylindrical support side. Thus, an uncured relief forming layer was formed.

<Curing Step>

Using a vulcanizer, the uncured relief forming layer was heated at 180° C. and 0.2 MPa for 10 minutes to form a relief forming layer. Thereafter, the surface of the relief forming layer was polished with a grinder and thus a seamless cylindrical printing plate precursor having a thickness unevenness in a range of 30 μm was obtained.

[Production of Cylindrical Printing Plate]

The cylindrical printing plate precursor obtained as above was laser-engraved by using a laser engraving machine (1300S manufactured by Hell Gravure Systems), then a washer (2% aqueous solution of JOY W Sterilization manufactured by The Procter & Gamble Company) was applied onto the plate, the plate was rubbed with a pig bristle brush, and washed with running water such that the engraving residue was removed. Thus, a cylindrical printing plate was obtained.

<Measurement of Hardness and Film Thickness of Cylindrical Printing Plate>

The hardness of the first hard layer, the soft layer, and the second hard layer of the obtained cylindrical printing plate was measured by using FischerScope HM2000Xyp (manufactured by Fischer Instruments K.K.).

Specifically, the surface of the relief layer of the produced cylindrical printing plate was vertically cut out into a size of about 3 cm square and the cylindrical printing plate was fixed onto a slide glass with an adhesive such that the cross section of the relief layer faced upwardly. The first hard layer, the soft layer, and the second hard layer were pressed by a measurement detector from the upper portions of the respective layers and in a case where each layer was pressed by 10 μm, the Martens hardness was obtained as the hardness of each layer.

In addition, the cross section of the cylindrical printing plate was photographed with a with a digital microscope KH-7700 (manufactured by Hirox Co., Ltd.) and the thickness of each of the first hard layer, the soft layer, and the second hard layer was measured.

The thickness and hardness of each layer were shown in Table 1.

Example 2

A cylindrical printing plate was produced in the same manner as in Example 1 except that in the preparation of the resin composition to form the first hard layer of the relief layer, the amount of PERCUMYL D-40 added was changed to 1.8 parts by mass to prepare a resin composition D, and a cylindrical printing plate in which the hardness K1 of the first hard layer was 19 MPa was obtained.

Example 3

A cylindrical printing plate was produced in the same manner as in Example 1 except that in the preparation of the resin composition to form the first hard layer of the relief layer, the amount of PERCUMYL D-40 added was changed to 1.0 part by mass to prepare a resin composition E, and a cylindrical printing plate in which the hardness K1 of the first hard layer was 10 MPa was obtained.

Example 4

A cylindrical printing plate was produced in the same manner as in Example 1 except that in the preparation of the resin composition to form the soft layer of the relief layer, the amount of PERCUMYL D-40 added was changed to 6 parts by mass to prepare a resin composition F, and a cylindrical printing plate in which the hardness K2 of the soft layer was 4 MPa was obtained.

Example 5

A cylindrical printing plate was produced in the same manner as in Example 1 except that in the preparation of the resin composition to form the second hard layer of the relief layer, the amount of PERCUMYL D-40 added was changed to 10 parts by mass to prepare a resin composition G, and a cylindrical printing plate in which the hardness K3 of the second hard layer was 5 MPa was obtained.

Example 6

A cylindrical printing plate was produced in the same manner as in Example 1 except that in the preparation of the resin composition to form the second hard layer of the relief layer, the amount of PERCUMYL D-40 added was changed to 15 parts by mass to prepare a resin composition H, and a cylindrical printing plate in which the hardness K3 of the second hard layer was 9 MPa was obtained.

Example 7

A cylindrical printing plate was produced in the same manner as in Example 1 except that as an underlayer of the second hard layer of the relief layer, a fourth layer was provided. As a resin composition I to form the fourth layer of the relief layer, a resin composition I was prepared in such a manner that using an MS type small pressurizing kneader, 100 parts by mass of BR150L as a polymer and 12 parts by mass of CARBON BLACK #45L were kneaded for 10 minutes at 80° C. with a front blade at 35 rpm and a rear blade at 35 rpm and then the kneaded product was cooled to 60° C., and 16 parts by mass of PERCUMYL D-40 was added thereto and kneaded for 10 minutes at 60° C. with a front blade at 20 rpm and a rear blade at 20 rpm to form the fourth layer of the relief layer.

Using the same calender rolls as in Example 1, an uncured layer I was produced and uncured layers A, B, C, and I were placed on the cylindrical support such that the uncured layers I, C, B, and A were arranged in this order from the cylindrical support side to form an uncured relief forming layer.

Thereafter, the uncured relief forming layer was cured in the same manner as in Example 1 and a relief layer was formed to produce a cylindrical printing plate precursor.

Further, the relief forming layer was laser-engraved in the same manner as in Example 1 to produce a cylindrical printing plate.

Example 8

A cylindrical printing plate was produced in the same manner as in Example 1 except that in the preparation of the resin composition to form the first hard layer of the relief layer, the amount of the polymer BR150L added was changed to 100 parts by mass and the amount of PERCUMYL D-40 added was changed to 20 parts by mass to prepare a resin composition J, and a cylindrical printing plate haivng a first hard layer not containing a crystalline polymer was obtained.

Example 9

A cylindrical printing plate was produced in the same manner as in Example 1 except that in the preparation of the resin composition to form the first hard layer of the relief layer, the amount of PERCUMYL D-40 added was changed to 1.2 parts by mass to prepare a resin composition K, and in the preparation of the resin composition to form the soft layer of the relief layer, the amount of PERCUMYL D-40 added was changed to 6 parts by mass to prepare a resin composition L, and a cylindrical printing plate in which the hardness ratio (K1/K2) was 2.75 was obtained.

Example 10

A cylindrical printing plate was produced in the same manner as in Example 1 except that in the preparation of the resin composition to form the soft layer of the relief layer, the amount of PERCUMYL D-40 added was changed to 6 parts by mass to prepare a resin composition L, and in the preparation of the resin composition to form the second hard layer of the relief layer, the amount of PERCUMYL D-40 added was changed to 10 parts by mass to prepare a resin composition M, and a cylindrical printing plate in which the hardness ratio (K3/K2) was 1.25 was obtained.

Examples 11 to 15

A cylindrical printing plate was produced in the same manner as in Example 1 except that the thickness of each layer of the relief layer was changed so as to adjust each roll interval between the first to fourth rolls of the calender rolls.

Comparative Example 1

A cylindrical printing plate was produced in the same manner as in Example 1 except that the thickness of the first hard layer of the relief layer was changed so as to adjust each roll interval between the first to fourth rolls of the calender rolls and the relief layer formed of only the first hard layer was arranged on the cylindrical support, and a cylindrical printing plate in which the relief layer was formed of one layer was obtained.

Comparative Example 2

A cylindrical printing plate was produced in the same manner as in Example 1 except that resin sheets A and B were placed on the cylindrical support such that the resin sheets B and A were arranged in this order from the cylindrical support side, and cured, and a cylindrical printing plate in which the relief layer was formed of two layers was obtained.

Comparative Example 3

A cylindrical printing plate was produced in the same manner as in Example 1 except that resin sheets B and C were placed on the cylindrical support such that the resin sheets C and B were arranged in this order from the cylindrical support side, and cured, and a cylindrical printing plate in which the relief layer was formed of two layers was obtained.

Comparative Example 4

A cylindrical printing plate was produced in the same manner as in Example 1 except that in the preparation of the resin composition to form the first hard layer of the relief layer, the amount of PERCUMYL D-40 added was changed to 2.0 parts by mass to prepare a resin composition N, and a cylindrical printing plate in which the hardness K1 of the first hard layer was 20 MPa was obtained.

Comparative Example 5

A cylindrical printing plate was produced in the same manner as in Example 1 except that in the preparation of the resin composition to form the first hard layer of the relief layer, the amount of PERCUMYL D-40 added was changed to 0.8 parts by mass to prepare a resin composition O, and a cylindrical printing plate in which the hardness K1 of the first hard layer was 9 MPa was obtained.

Comparative Example 6

A cylindrical printing plate was produced in the same manner as in Example 1 except that in the preparation of the resin composition to form the first hard layer of the relief layer, the amount of PERCUMYL D-40 added was changed to 1.0 part by mass to prepare a resin composition E, and in the preparation of the resin composition to form the soft layer of the relief layer, the amount of PERCUMYL D-40 added was changed to 8 parts by mass to prepare a resin composition P, and a cylindrical printing plate in which the hardness K2 of the soft layer was 5 MPa was obtained.

Comparative Example 7

A cylindrical printing plate was produced in the same manner as in Example 1 except that in the preparation of the resin composition to form the first hard layer of the relief layer, the amount of PERCUMYL D-40 added was changed to 1.0 part by mass to prepare a resin composition E, in the preparation of the resin composition to form the soft layer of the relief layer, the amount of PERCUMYL D-40 added was changed to 6 parts by mass to prepare a resin composition F, and in the preparation of the resin composition to form the second hard layer of the relief layer, the amount of PERCUMYL D-40 added was changed to 17 parts by mass to prepare a resin composition Q, and a cylindrical printing plate in which the hardness K3 of the second hard layer was 11 MPa was obtained.

Comparative Example 8

A cylindrical printing plate was produced in the same manner as in Example 1 except that in the preparation of the resin composition to form the soft layer of the relief layer, the amount of PERCUMYL D-40 added was changed to 6 parts by mass to prepare a resin composition L, and in the preparation of the resin composition to form the second hard layer of the relief layer, the amount of PERCUMYL D-40 added was changed to 8 parts by mass to prepare a resin composition R, and a cylindrical printing plate in which the hardness K3 of the second hard layer was 4 MPa was obtained.

Comparative Example 9 to 12

A cylindrical printing plate was produced in the same manner as in Example 1 except that the thickness of each layer of the relief layer was changed so as to adjust each roll interval between the first to fourth rolls of the calender rolls. The thickness of each layer is shown in Table 1.

Regarding Examples 1 to 15 and Comparative Examples 1 to 12, the hardness and thickness of each layer of the relief layer are shown in Table 1.

TABLE 1

| | | Hardness | | | | | | Thickness | | | | Total thickness of first hard layer, soft layer, and second hard layer |
|---|---|---|---|---|---|---|---|---|---|---|---|---|
| | First hard layer polymer | First hard layer K1 [MPa] | Soft layer K2 [MPa] | Second hard layer K3 [MPa] | Fourth layer K4 [MPa] | Hardness Ratio K1/K2 | Hardness Ratio K3/K2 | First hard layer [mm] | Soft layer [mm] | Second hard layer [mm] | Fourth layer [mm] | [mm] |
| Example | | | | | | | | | | | | |
| Example 1 | RB820 | 15 | 3 | 7 | — | 5.00 | 2.33 | 0.1 | 1.0 | 4.0 | — | 5.1 |
| Example 2 | RB820 | 19 | 3 | 7 | — | 6.33 | 2.33 | 0.1 | 1.0 | 4.0 | — | 5.1 |
| Example 3 | RB820 | 10 | 3 | 7 | — | 3.33 | 2.33 | 0.1 | 1.0 | 4.0 | — | 5.1 |
| Example 4 | RB820 | 15 | 4 | 7 | — | 3.75 | 1.75 | 0.1 | 1.0 | 4.0 | — | 5.1 |
| Example 5 | RB820 | 15 | 3 | 5 | — | 5.00 | 1.67 | 0.1 | 1.0 | 4.0 | — | 5.1 |
| Example 6 | RB820 | 15 | 3 | 9 | — | 5.00 | 3.00 | 0.1 | 1.0 | 4.0 | — | 5.1 |
| Example 7 | RB820 | 15 | 3 | 7 | 10 | 5.00 | 2.33 | 0.1 | 1.0 | 4.0 | 1.0 | 5.1 |
| Example 8 | BR150L | 15 | 3 | 7 | — | 5.00 | 2.33 | 0.1 | 1.0 | 4.0 | — | 5.1 |
| Example 9 | RB820 | 11 | 4 | 7 | — | 2.75 | 1.75 | 0.1 | 1.0 | 4.0 | — | 5.1 |
| Example 10 | R8820 | 15 | 4 | 5 | — | 3.75 | 1.25 | 0.1 | 1.0 | 4.0 | — | 5.1 |
| Example 11 | RB820 | 15 | 3 | 7 | — | 5.00 | 2.33 | 0.3 | 1.0 | 4.0 | — | 5.3 |
| Example 12 | RB820 | 15 | 3 | 7 | — | 5.00 | 2.33 | 0.05 | 1.0 | 4.0 | — | 5.1 |
| Example 13 | RB820 | 15 | 3 | 7 | — | 5.00 | 2.33 | 0.1 | 2.0 | 4.0 | — | 6.1 |
| Example 14 | RB820 | 15 | 3 | 7 | — | 5.00 | 2.33 | 0.1 | 0.3 | 4.0 | — | 4.4 |
| Example 15 | RB820 | 15 | 3 | 7 | — | 5.00 | 2.33 | 0.3 | 2.0 | 2.0 | | 4.3 |

TABLE 1-continued

| | First hard layer polymer | Hardness: First hard layer K1 [MPa] | Hardness: Soft layer K2 [MPa] | Hardness: Second hard layer K3 [MPa] | Hardness: Fourth layer K4 [MPa] | Hardness Ratio: K1/K2 | Hardness Ratio: K3/K2 | Thickness: First hard layer [mm] | Thickness: Soft layer [mm] | Thickness: Second hard layer [mm] | Thickness: Fourth layer [mm] | Total thickness of first hard layer, soft layer, and second hard layer [mm] |
|---|---|---|---|---|---|---|---|---|---|---|---|---|
| Comparative Example | | | | | | | | | | | | |
| Comparative Example 1 | R8820 | 15 | — | — | — | — | — | 5.0 | — | — | — | 5.0 |
| Comparative Example 2 | RB820 | 15 | 3 | — | — | 5.00 | — | 0.1 | — | 4.0 | — | 4.1 |
| Comparative Example 3 | — | — | 3 | 7 | — | — | 2.33 | — | 1.0 | 4.0 | — | 5.0 |
| Comparative Example 4 | RB820 | 20 | 3 | 7 | — | 6.67 | 2.33 | 0.1 | 1.0 | 4.0 | — | 5.1 |
| Comparative Example 5 | RB820 | 9 | 3 | 7 | — | 3.00 | 2.33 | 0.1 | 1.0 | 4.0 | — | 5.1 |
| Comparative Example 6 | RB820 | 10 | 5 | 7 | — | 2.00 | 1.40 | 0.1 | 1.0 | 4.0 | — | 5.1 |
| Comparative Example 7 | RB820 | 10 | 4 | 11 | — | 2.50 | 2.75 | 0.1 | 1.0 | 4.0 | — | 5.1 |
| Comparative Example 8 | RB820 | 15 | 4 | 4 | — | 3.75 | 1.00 | 0.1 | 1.0 | 4.0 | — | 5.1 |
| Comparative Example 9 | RB820 | 15 | 3 | 7 | — | 5.00 | 2.33 | 0.4 | 0.3 | 3.0 | — | 3.7 |
| Comparative Example 10 | RB820 | 15 | 3 | 7 | — | 5.00 | 2.33 | 0.04 | 0.3 | 3.0 | — | 3.3 |
| Comparative Example 11 | RB820 | 15 | 3 | 7 | — | 5.00 | 2.33 | 0.05 | 2.1 | 2.0 | — | 4.2 |
| Comparative Example 12 | RB820 | 15 | 3 | 7 | — | 5.00 | 2.33 | 0.1 | 0.2 | 3.0 | — | 3.3 |

[Evaluation]

Printing was performed by using the obtained cylindrical printing plate. For solid density evaluation and halftone dot quality evaluation, 2% halftone dot density evaluation was performed, for print medium followability evaluation, blur evaluation of the solid image area was performed, and for printing durability evaluation, evaluation of continuous printing of 2% halftone dots was performed, and for film thickness accuracy evaluation, surface roughness evaluation was performed.

(Printing Step)

The obtained cylindrical printing plate was set to a CI drum type flexographic printing machine (MIRAFLEX AM&C, manufactured by Ri-tech, Inc.). As a printing ink, an aqueous ink (HYDRIC FCG, 739 indigo (manufactured by Dainichiseika Color & Chemicals Mfg. Co., Ltd.)) was used. For paper as an object to be printed, AURORA COAT (manufactured by Nippon Paper Industries Co., Ltd., thickness: 100 μm, Rz: 2.7 to 3.0 μm) was used. The kiss-touch (printing pressure at which the entire image surface is begun to be inked) was set to 0 (reference printing pressure) and then under the condition of pressing the plate by 40 μm, printing was performed at a printing rate of 150 m/min.

<Evaluation of Solid Density and Halftone Dot Quality>

The reflection density (cyan) of the solid image area and the 2% halftone dot portion of the printed material obtained by printing was measured with a reflective densitometer (RD-19I, manufactured by GretagMacbeth GmbH).

Regarding the solid density, as the value of the reflection density becomes larger, the quality becomes more satisfactory. In Table 2, the evaluation result "3 points" denotes that the reflection density is 1.60 or more, and the evaluation result "2 points" denotes that the reflection density is 1.50 or more and less than 1.60 and is within an allowable range. In addition, in Table 2, the evaluation result "1 point" denotes that the reflection density is less than 1.50 and is not allowable.

Regarding the 2% halftone dot density, as a density difference from a reflection density of 0.025 becomes smaller, the quality becomes more satisfactory. In Table 2, the evaluation result "3 points" denotes that the density difference is less than 0.005, and the evaluation result "2 points" denotes that the density difference is 0.005 or more and less than 0.010 and is within an allowable range. In addition, in Table 2, the evaluation result "1 point" denotes that the reflection density difference is 0.010 or more and is not allowable.

<Print Medium Followability Evaluation>

For the print medium followability evaluation, the degree of blurs of the solid image area of the printed material obtained by printing was visually evaluated into 3 grades. The evaluation result "3 points" denotes that almost no blurs are made, the evaluation result "2 points" denotes that blurs are made but are allowable, and the evaluation result "1 point" denotes that blurs are not at an allowable level.

<Printing Durability Evaluation>

The pressing amount at the time of printing was changed to 160 μm and continuous printing was performed to confirm 2% halftone dots in the printed material. Printing was ended at the time of generation of halftone dots which were not printed and the length (meter) of the paper printed until ending of printing was used as an index for printing durability. As the length of the printed paper becomes longer, the printing durability becomes more satisfactory. In Table 2, the evaluation result "3 points" denotes that the length of the printed paper is 3000 m or longer, and the evaluation result "2 points" denotes that the length of the printed paper is 2000 m or longer and is within an allowable range. In addition, in Table 2, the evaluation result "1 point" denotes that the length of the printed paper is shorter than 2000 m and is not allowable.

<Evaluation of Film Thickness Accuracy>

For evaluation of the film thickness accuracy of the cylindrical printing plate, the film thickness was measured at 20 locations in the surface of the cylindrical printing plate precursor to obtain an average roughness Rz. As the average roughness Rz becomes smaller, the film thickness accuracy becomes more satisfactory.

In Table 2, the evaluation result "3 points" denotes that the Rz is less than 20 μm and the evaluation result "2 points" denotes that the Rz is 20 μm or more and less than 30 μm and is within an allowable range.

The evaluation results of Examples 1 to 15 and Comparative Examples 1 to 12 are shown in Table 2.

From the results shown in Table 2, it is found that in Examples 1 to 15 of the present invention, compared to Comparative Examples 1 to 12, the halftone dot quality (2% halftone dot density difference), the solid density, the print medium followability (blur) and the printing durability are excellent.

From the comparison of Example 8 and Examples other than Example 8, it is found that in a case where the resin composition of the first hard layer contains RB820 which is a crystalline polymer, the film thickness accuracy is excellent.

From the comparison of Example 1 and Examples 2 and 3, it is found that in a case where the hardness (K1) of the first hard layer is 13 MPa or more and 18 MPa or less, the printing durability and the halftone dot quality are excellent.

From the comparison of Examples 1 and 4, it is found that in a case where the hardness (K2) of the soft layer is 3 MPa or less, the print medium followability is satisfactory.

From the comparison of Example 1 and Examples 5 and 6, it is found that in a case where the hardness (K3) of the

TABLE 2

| | Evaluation | | | | |
|---|---|---|---|---|---|
| | Halftone dot quality (2% halftone dot density difference) [point] | Solid density [point] | Print medium followability (blur) [point] | Printing durability [point] | Film thickness accuracy [point] |
| Example | | | | | |
| Example 1 | 3 | 3 | 3 | 3 | 3 |
| Example 2 | 3 | 3 | 3 | 2 | 3 |
| Example 3 | 2 | 3 | 3 | 3 | 3 |
| Example 4 | 3 | 3 | 2 | 3 | 3 |
| Example 5 | 3 | 3 | 2 | 3 | 3 |
| Example 6 | 3 | 2 | 3 | 3 | 3 |
| Example 7 | 3 | 3 | 3 | 3 | 3 |
| Example 8 | 3 | 3 | 3 | 3 | 2 |
| Example 9 | 2 | 3 | 2 | 3 | 3 |
| Example 10 | 3 | 3 | 2 | 3 | 3 |
| Example 11 | 3 | 3 | 2 | 3 | 3 |
| Example 12 | 2 | 3 | 3 | 3 | 3 |
| Example 13 | 3 | 2 | 3 | 3 | 3 |
| Example 14 | 3 | 3 | 2 | 3 | 3 |
| Example 15 | 3 | 2 | 3 | 3 | 3 |
| Comparative Example | | | | | |
| Comparative Example 1 | 3 | 1 | 1 | 3 | 3 |
| Comparative Example 2 | 3 | 1 | 3 | 3 | 3 |
| Comparative Example 3 | 1 | 1 | 3 | 3 | 2 |
| Comparative Example 4 | 3 | 3 | 3 | 1 | 3 |
| Comparative Example 5 | 1 | 3 | 3 | 3 | 3 |
| Comparative Example 6 | 2 | 3 | 1 | 3 | 3 |
| Comparative Example 7 | 2 | 3 | 1 | 3 | 3 |
| Comparative Example 8 | 3 | 1 | 2 | 3 | 3 |
| Comparative Example 9 | 3 | 3 | 1 | 3 | 3 |
| Comparative Example 10 | 1 | 3 | 2 | 3 | 3 |
| Comparative Example 11 | 2 | 1 | 3 | 3 | 3 |
| Comparative Example 12 | 3 | 3 | 1 | 3 | 3 |

second hard layer is 6 MPa or more and 8 MPa or less, the solid density and the print medium followability are excellent.

From the comparison of Example 1 and Examples 11 and 12, it is found that in a case where the thickness of the first hard layer is 0.1 mm or more and 0.15 mm or less, the print medium followability and the halftone dot quality are satisfactory.

From the comparison of Example 1 and Examples 13 and 14, it is found that in a case where the thickness of the soft layer is 1.0 mm or more and 1.5 mm or less, the solid density and the print medium followability are excellent.

From the comparison of Example 1 and Example 15, it is found that in a case where the thickness of the second hard layer is 3.0 mm or more, the solid density is excellent.

From the above results, the effects of the present invention are clear.

EXPLANATION OF REFERENCES

01: cylindrical printing plate precursor
02: relief forming layer
03: first hard layer
04: soft layer
05: second hard layer
07: cylindrical support
08: cylindrical printing plate
09: image area
10: non-image area
11: relief layer
12: solid image area
13: halftone dot portion
14: calender roll
15*a*: first roll
15*b*: second roll
15*c*: third roll
15*d*: fourth roll
16: kneaded product
17: uncured layer
18: flexographic printing apparatus
19: rotation axis
20: transport roller
21: anilox roller
22: doctor chamber
23: circulation tank
24: object to be printed
25: slide glass
26: adhesive
27: measurement detector

What is claimed is:

1. A cylindrical printing plate comprising:
a relief layer having a first hard layer, a soft layer, and a second hard layer in this order from a printing surface side,
wherein a hardness K1 of the first hard layer is 10 MPa or more and less than 20 MPa,
a ratio K1/K2 of the hardness K1 of the first hard layer with respect to a hardness K2 of the soft layer is 2.7 or more,
a ratio K3/K2 of a hardness K3 of the second hard layer with respect to the hardness K2 of the soft layer is 1.2 or more,
a thickness of the first hard layer is 0.05 mm or more and 0.3 mm or less, and
a thickness of the soft layer is 0.3 mm or more and 2.0 mm or less.

2. The cylindrical printing plate according to claim 1,
wherein the hardness K2 of the soft layer is less than 5 MPa.

3. The cylindrical printing plate according to claim 1,
wherein the hardness K3 of the second hard layer is 5 MPa or more and less than 10 MPa.

4. The cylindrical printing plate according to claim 1,
wherein a thickness of the second hard layer is 2.0 mm or more.

5. The cylindrical printing plate according to claim 1,
wherein the first hard layer contains a crystalline polymer.

6. The cylindrical printing plate according to claim 1,
wherein the crystalline polymer is at least one selected from a polybutadiene-based thermoplastic elastomer and a polyolefin-based thermoplastic elastomer.

7. A cylindrical printing plate precursor comprising:
a relief forming layer having a first hard layer, a soft layer, and a second hard layer in this order from a printing surface side,
wherein a hardness K1 of the first hard layer is 10 MPa or more and less than 20 MPa,
a ratio K1/K2 of the hardness K1 of the first hard layer with respect to a hardness K2 of the soft layer is 2.7 or more,
a ratio K3/K2 of a hardness K3 of the second hard layer with respect to the hardness K2 of the soft layer is 1.2 or more,
a thickness of the first hard layer is 0.05 mm or more and 0.3 mm or less, and
a thickness of the soft layer is 0.3 mm or more and 2.0 mm or less.

8. The cylindrical printing plate precursor according to claim 7,
wherein the hardness K2 of the soft layer is less than 5 MPa.

9. The cylindrical printing plate precursor according to claim 7,
wherein the hardness K3 of the second hard layer is 5 MPa or more and less than 10 MPa.

10. The cylindrical printing plate precursor according to claim 7,
wherein a thickness of the second hard layer is 2.0 mm or more.

11. The cylindrical printing plate precursor according to claim 7,
wherein the first hard layer contains a crystalline polymer.

12. The cylindrical printing plate precursor according to claim 11,
wherein the crystalline polymer is at least one selected from a polybutadiene-based thermoplastic elastomer and a polyolefin-based thermoplastic elastomer.

13. A method for manufacturing a cylindrical printing plate precursor comprising:
an uncured layer forming step of forming, on a peripheral surface of a cylindrical support, an uncured relief forming layer having a first uncured layer which becomes a first hard layer, a second uncured layer which becomes a soft layer, and a third uncured layer which becomes a second hard layer in this order from the cylindrical support; and
a curing step of curing the formed first uncured layer, second uncured layer, and third uncured layer to form a relief forming layer having the first hard layer, the soft layer, and the second hard layer,
wherein a hardness K1 of the first hard layer after curing is 10 MPa or more and less than 20 MPa, a ratio K1/K2 of the hardness K1 of the first hard layer with respect to a hardness K2 of the soft layer after curing is 2.7 or more, a ratio K3/K2 of a hardness K3 of the second hard layer with respect to the hardness K2 of the soft layer after curing is 1.2 or more, a thickness of the first hard layer after curing is 0.05 mm or more and 0.3 mm or less, and a thickness of the soft layer after curing is 0.3 mm or more and 2.0 mm or less.

14. A method of manufacturing a cylindrical printing plate comprising:

an engraving step of performing laser engraving on the relief forming layer of the cylindrical printing plate precursor manufactured by the method of manufacturing a cylindrical printing plate precursor according to claim 13 to form a relief layer.

* * * * *